US009419370B1

(12) United States Patent
Keep et al.

(10) Patent No.: US 9,419,370 B1
(45) **Date of Patent: *Aug. 16, 2016**

(54) SEALED ELECTRICAL CONNECTOR ASSEMBLY

(71) Applicant: Glenair, Inc., Glendale, CA (US)

(72) Inventors: Aaron N. Keep, Paso Robles, CA (US); Zachary W. Taylor, Paso Robles, CA (US); Jameson S. Mora, Paso Robles, CA (US)

(73) Assignee: GLENAIR, INC., Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/134,387

(22) Filed: Apr. 21, 2016

Related U.S. Application Data

(63) Continuation of application No. 14/735,996, filed on Jun. 10, 2015, now Pat. No. 9,368,903, which is a continuation-in-part of application No. 14/685,580, filed on Apr. 13, 2015, now Pat. No. 9,356,387.

(51) Int. Cl.

| | |
|---|---|
| ***H01R 13/40*** | (2006.01) |
| ***H01R 13/52*** | (2006.01) |
| ***H01R 43/00*** | (2006.01) |
| ***H01R 13/502*** | (2006.01) |

(52) U.S. Cl.
CPC ..... *H01R 13/5205* (2013.01); *H01R 13/502* (2013.01); *H01R 43/005* (2013.01)

(58) Field of Classification Search
None
See application file for complete search history.

(56) References Cited

U.S. PATENT DOCUMENTS

| | | | | |
|---|---|---|---|---|
| 5,458,507 | A | 10/1995 | Colescott et al. | |
| 7,408,122 | B2 | 8/2008 | Heimlicher et al. | |
| 8,113,878 | B2 | 2/2012 | Clausen | |
| 8,919,221 | B2 | 12/2014 | Chiou | |
| 9,356,387 | B1 * | 5/2016 | Taylor | H01R 13/512 |
| 9,368,903 | B1 * | 6/2016 | Keep | H01R 13/5205 |

OTHER PUBLICATIONS

Co-owned U.S. Appl. No. 14/685,580, filed Apr. 13, 2016.
Allowance dated Apr. 4, 2016 in co-owned U.S. Appl. No. 14/685,580.
Co-owned U.S. Appl. No. 14/735,996, filed Jun. 10, 2016.
Office action dated Apr. 4, 2016 in co-owned U.S. Appl. No. 14/735,996.
Allowance dated Apr. 26, 2016 in co-owned U.S. Appl. No. 14/735,996.

* cited by examiner

*Primary Examiner* — Tho D Ta
(74) *Attorney, Agent, or Firm* — David S. Alavi

(57) ABSTRACT

A connector assembly comprises front and rear connector bodies, a wire grommet with wire passages, and a nut. Tightening the nut forces a rearward portion of the grommet into a tapered segment of a passage through the rear connector body and a forward portion of the rear connector body into a front passage of the front connector body, thereby radially compressing the grommet and sealing the wires passing therethrough.

19 Claims, 19 Drawing Sheets

SEALED ELECTRICAL CONNECTOR ASSEMBLY

This application is a continuation of U.S. non-provisional application Ser. No. 14/735,996 entitled "Sealed electrical connector assembly" filed Jun. 10, 2015 in the names of Keep et al, which is a continuation-in-part of U.S. non-provisional application Ser. No. 14/685,580 entitled "Sealed electrical connector assembly" filed Apr. 13, 2015 in the names of Taylor et al (hereinafter referred to as the '580 application); both of said applications are incorporated by reference as if fully set forth herein.

FIELD OF THE INVENTION

The field of the present invention relates to electrical connector assemblies. In particular, a sealed electrical connector assembly including a radially compressed wire grommet is disclosed herein.

BACKGROUND

In certain circumstances it is desirable to isolate from a use environment the electrical contacts and wires within an electrical connector assembly. One such circumstance arises when electrical connectors are employed in aviation. Exposure to extremes of temperature, pressure, or humidity, and frequent cycling between those extremes (e.g., with each takeoff, climb, cruise, descent, and landing) can lead to corrosion or other degradation of the electrically conductive parts of the connector. In certain conventional electrical connector assemblies a resiliently deformable wire grommet is employed to seal around one or more wires that enter the connector assembly. It may be desirable to provide improved or enhanced sealing around the wires by a wire grommet.

An example of a conventional connector assembly (arranged according to an SAE AS50151 standard in the example shown) is shown in FIGS. 12-18 and comprises a substantially rigid front connector body 30; a substantially rigid rear connector body 20; a resiliently deformable wire grommet 10; and a threaded nut 40. The rear connector body 20 (also referred to as a connector accessory or as a connector backshell) has a rear axial passage 22 therethrough; the front connector body 30 (also referred to as a plug connector body in a plug-type connector assembly, or as a receptacle connector body in a receptacle-type connector assembly) has a front axial passage. When the connector assembly is connected to one or more wires 90 (three wires 90 in the examples shown, with spaces for more; any suitable number of one or more wires can be employed) and assembled, a resiliently deformable wire grommet 10 is positioned within the front axial passage and the wires 90 pass through the rear axial passage 22 and through corresponding wire passages 12 of the grommet 10. An insulating body 38 of the front connector body 30 is structurally arranged so as to hold one or more electrical contacts 92 that are each connected to a corresponding wire 90. In the examples shown the electrical contacts 92 are pin contacts; in other examples the contacts are socket contacts. The wire grommet 10 serves to isolate the electrical contacts 92 and the conductive cores of the wires 90 from a use environment.

The front connector body 30 of the conventional connector assembly has triangular teeth 39 arranged just outside the rear end of the front axial passage; the rear connector body 20 of the conventional connector assembly has mating triangular teeth 29 arranged around the front end of the rear axial passage 22. The rear connector body 20 of the conventional connecter assembly also can have a so-called web 29*w* between the teeth 29 but not extending beyond the tips of the teeth 29. The teeth 29 and 39 engage one another when the front connector body 30 and the rear connector body are assembled, but no portion of the teeth 29, the web 29*w*, or the connector body 29 extends forward into the interior of the front connector body 30 (i.e., forward beyond base portions of the teeth 39).

The nut 40 includes a central opening and internal threads 44. The nut 40 is structurally arranged so as to receive through the central opening a rearward portion of the rear connector body 20 and to obstruct rearward movement of the forward portion of the rear connector body 20 through the central opening. In the example embodiment shown, an outward circumferential flange 28 of the rear connector body 20 is too large to pass an inward circumferential flange 46 of the nut 40. A rearward portion of the front connector body 30 includes external threads 34 that engage the internal threads 44 of the nut 40. Tightening of the nut 40 threadedly engaged on the rearward portion of the front connector body 30 (via threads 34/44) results in forward movement of the nut 40 and the rear connector body 20 toward the front connector body 30; fully tightening the nut 40 results in fully engaged assembly of the connector bodies 30 and 20 and engagement of the teeth 29 and 39.

The wire grommet 10 has a substantially cylindrical outer surface and one or more axial wire passages 12 therethrough. Each wire passage 12 includes two or more wire-sealing segments 12*a* (also referred to as glands) and an intervening, transversely enlarged, internal chamber 12*b* between each adjacent pair of wire-sealing segments 12*a* along each wire passage 12. Each wire-sealing segment 12*a* is sized and shaped so as to (i) enable a corresponding wire 90 to be inserted through the corresponding wire passage 12 and (ii) form a seal around the corresponding inserted wire 90. A rear portion of the wire grommet 10 extends rearward beyond the rear end of the front connector body 30 and is received within a rearward-tapered forward segment 24 of the rear axial passage 22. The nut 40 is tightened and the front and rear connector bodies 30 and 20 are fully engaged (by engagement of the teeth 39 and 29), the tapered segment 24 radially compresses the protruding rearward portion of the wire grommet 10 and only the hindmost wire-sealing segment 12*a* of each passage 12.

The introduction of lighter-weight wires with spiral tape insulation has been beneficial for overall weight reduction in avionics applications. However, those wires tend to have an oval or elliptical cross section and an uneven outer insulator surface where adjacent tape windings overlap, resulting in inadequate sealing of the wires by conventional connector assemblies. Inadequately sealed connectors are subject to more rapid corrosion, resulting in premature connector degradation or failure and requiring more frequent repair or replacement. It would be desirable to provide a connector assembly that provides improved sealing, particularly around wires with non-circular cross sections or uneven outer insulator surfaces.

SUMMARY

An inventive connector assembly comprises a substantially rigid front connector body, a substantially rigid rear connector body, a resiliently deformable wire grommet, and a threaded nut. The resiliently deformable wire grommet has a substantially cylindrical outer surface and one or more axial wire passages therethrough. Each wire passage includes two or more wire-sealing segments; each wire-sealing segment is sized and shaped so as to (i) enable a corresponding wire to be inserted through the corresponding wire passage and (ii) form a seal around the corresponding inserted wire. The front connector body has a front axial passage. A rearward portion of the front connector body includes external threads. A forward portion of the front connector body is structurally arranged so as to hold one or more electrical contacts that are each connected to a corresponding wire passing through the rear axial passage and the corresponding wire passage of the grommet. At least portions, including a rearward portion, of the front axial passage are structurally arranged so as to receive therein the grommet without substantial radial compression of the grommet.

The rear connector body has a rear axial passage therethrough. A front end of the rear axial passage is large enough to receive therein a rearward portion of the grommet without substantial radial compression of the grommet. A rearward-tapered segment of the rear axial passage is structurally arranged so as to receive therein the rearward portion of the grommet, engage the outer surface of the rearward portion of the grommet, and compress radially the rearward portion of the grommet and one or more of the wire-sealing segments of each wire passage therein. A forward portion of the rear connector body, including at least a portion of the tapered segment of the rear axial passage, is structurally arranged to extend into and fit within the rearward portion of the front axial passage, interposed between the rearward portion of the grommet and an inner surface of the rearward portion of the front axial passage.

The nut has a central opening and internal threads. The nut is structurally arranged so as to (i) receive through the central opening a rearward portion of the rear connector body, (ii) obstruct rearward movement of the forward portion of the rear connector body through the central opening, and (iii) engage with the internal threads the external threads of the front connector body. The forward portion of the rear connector body and the rearward portion of the front connector body are structurally adapted so as to effect non-rotatable engagement of the front and rear connector bodies. The connector assembly is structurally arranged so that tightening of the nut threadedly engaged on the rearward portion of the front connector body results in forward movement of the nut and the rear connector body toward the front connector body, forward movement of the forward portion of the rear connector body into the rearward portion of the front axial passage, rearward movement of the rearward portion of the grommet into the tapered segment of the rear axial passage, and radial compression, by the tapered segment of the rear axial passage, of the rearward portion of the grommet and one or more of the wire-sealing segments of each wire passage therein.

A method employing the inventive connector assembly comprises: (a) inserting each one of a set of one or more wires through the wire grommet through a corresponding one of the one or more wire passages; (b) securing one or more corresponding electrical contacts, connected to the forward ends of the wires, to be held by the forward portion of the front connector body; (c) inserting the grommet into the front axial passage; (d) engaging the front and rear connector bodies; (e) threadedly engaging the nut and the front connector body; and (f) tightening of the nut threadedly engaged on the rearward portion of the front connector body, thereby resulting in forward movement of the nut and the rear connector body toward the front connector body, forward movement of the forward portion of the rear connector body into the rearward portion of the front axial passage, rearward movement of the rearward portion of the grommet into the tapered segment of the rear axial passage, and radial compression, by the tapered segment of the rear axial passage, of the rearward portion of the grommet and one or more of the wire-sealing segments of each wire passage therein.

Objects and advantages pertaining to sealed electrical connector assemblies may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The embodiments depicted are shown only schematically: all features may not be shown in full detail or in proper proportion, certain features or structures may be exaggerated relative to others for clarity, and the drawings should not be regarded as being to scale. In FIGS. 3-7, 8B, 9B, and 14-18, cross hatching has been omitted to reduce clutter in the drawings. The embodiments shown are only examples: they should not be construed as limiting the scope of the present disclosure or appended claims.

DETAILED DESCRIPTION OF EMBODIMENTS

Figure 1:
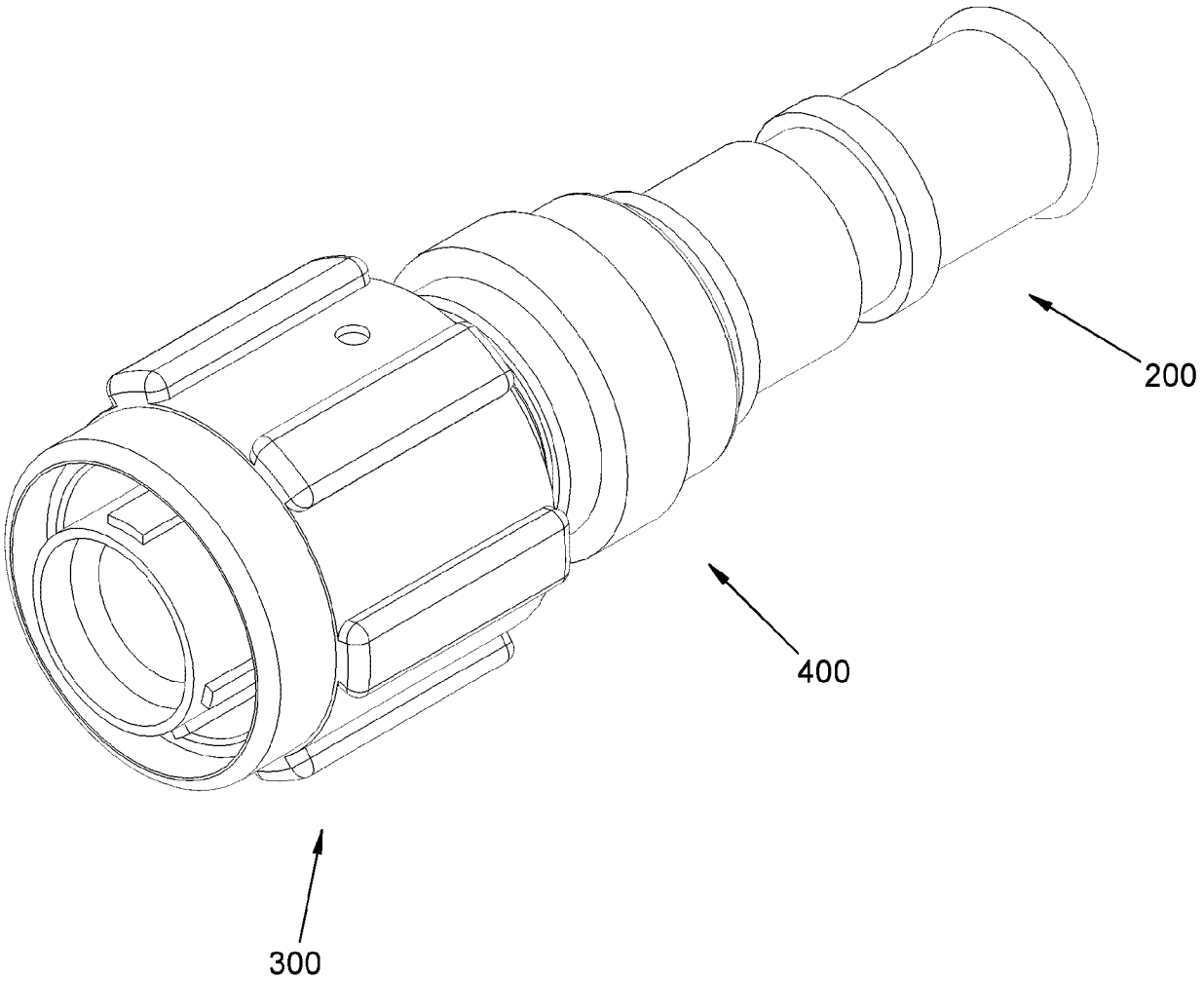
FIG. 1 is an isometric view of an example of an inventive sealed electrical connector assembly with wires in a fully assembled arrangement.
Figure 2:
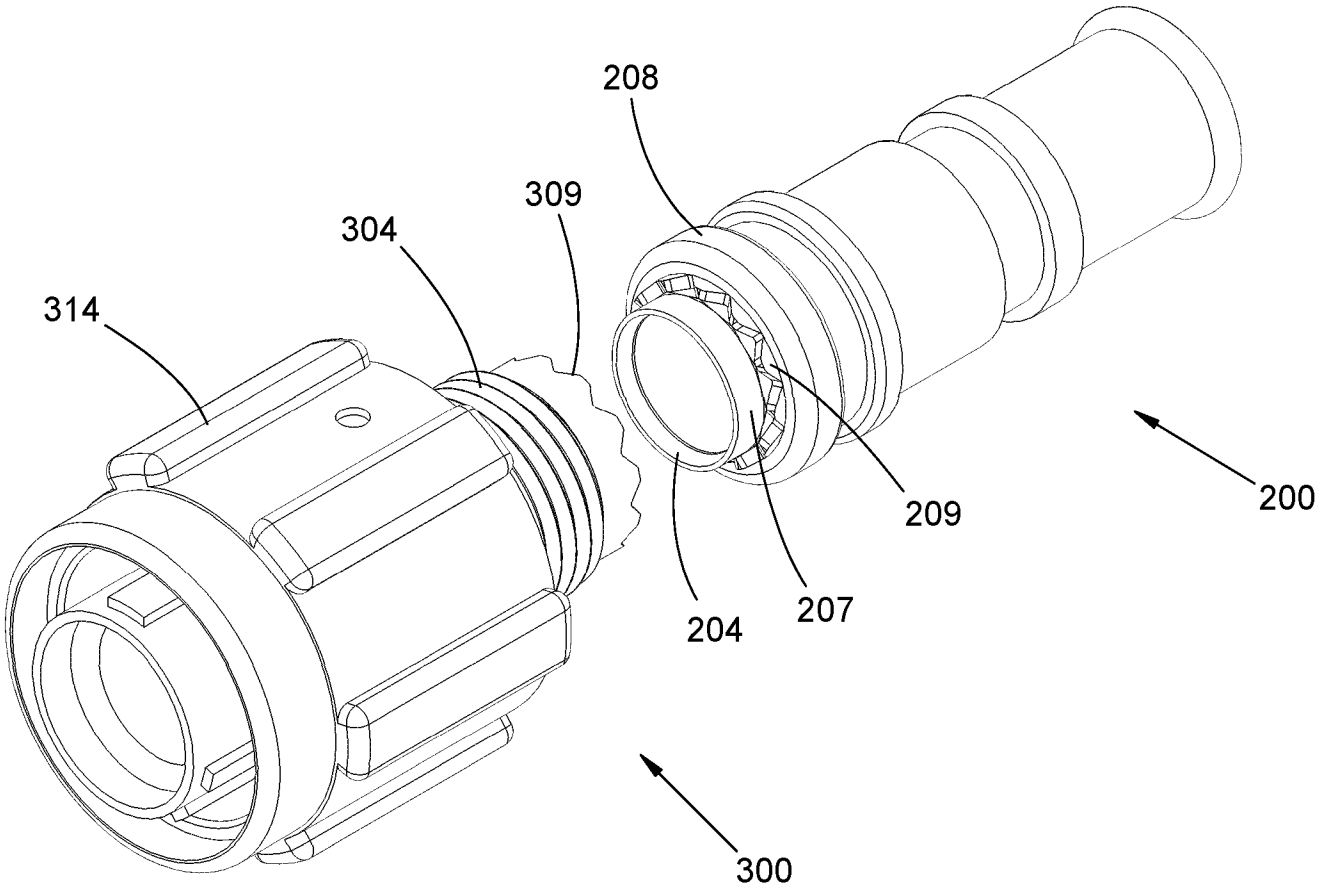
FIG. 2 is an isometric view of front and rear connector bodies of the example inventive connector assembly.
Figure 3:
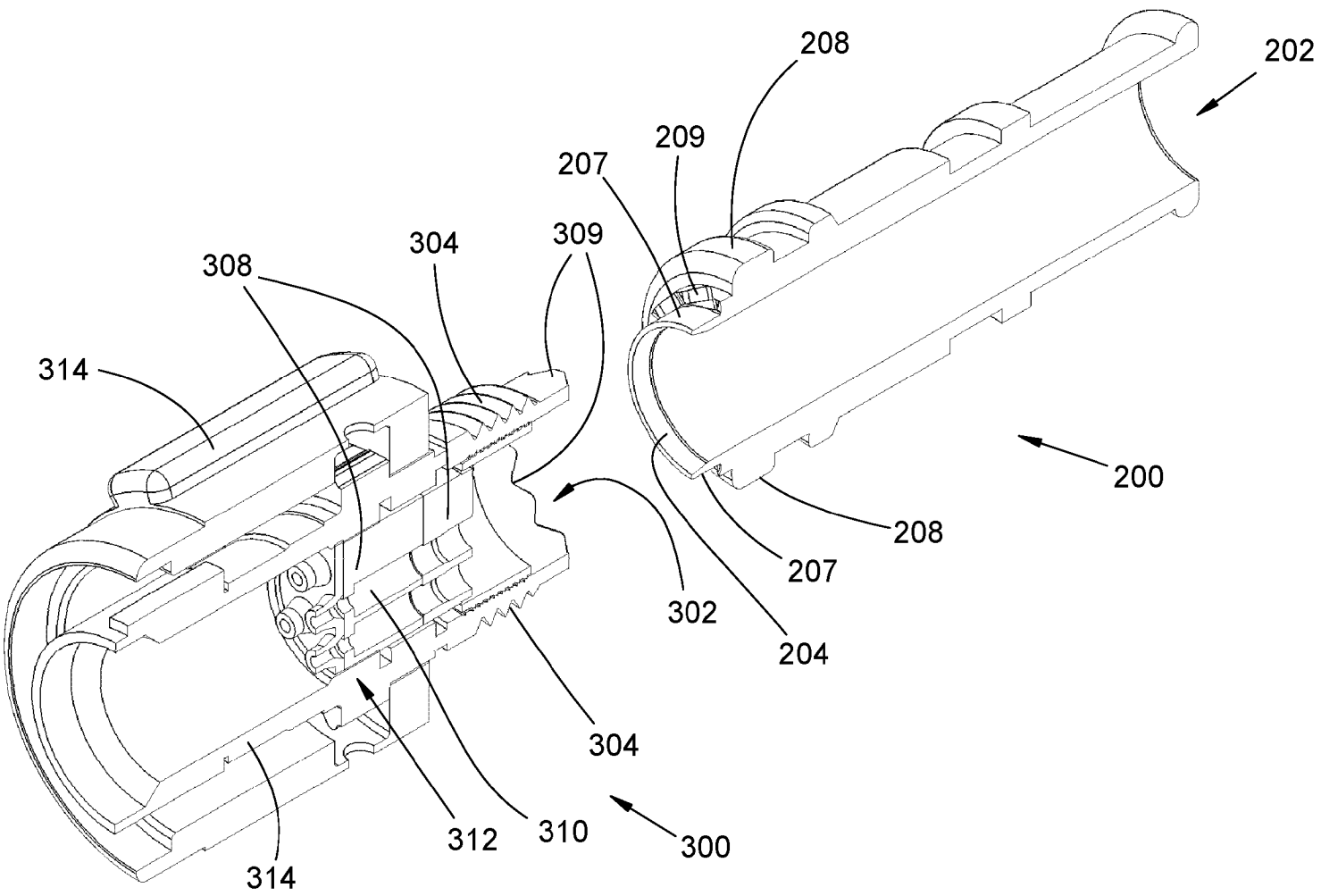
FIG. 3 is an isometric view of a longitudinal cross section of the front and rear connector bodies of the example inventive connector assembly.
Figure 4:
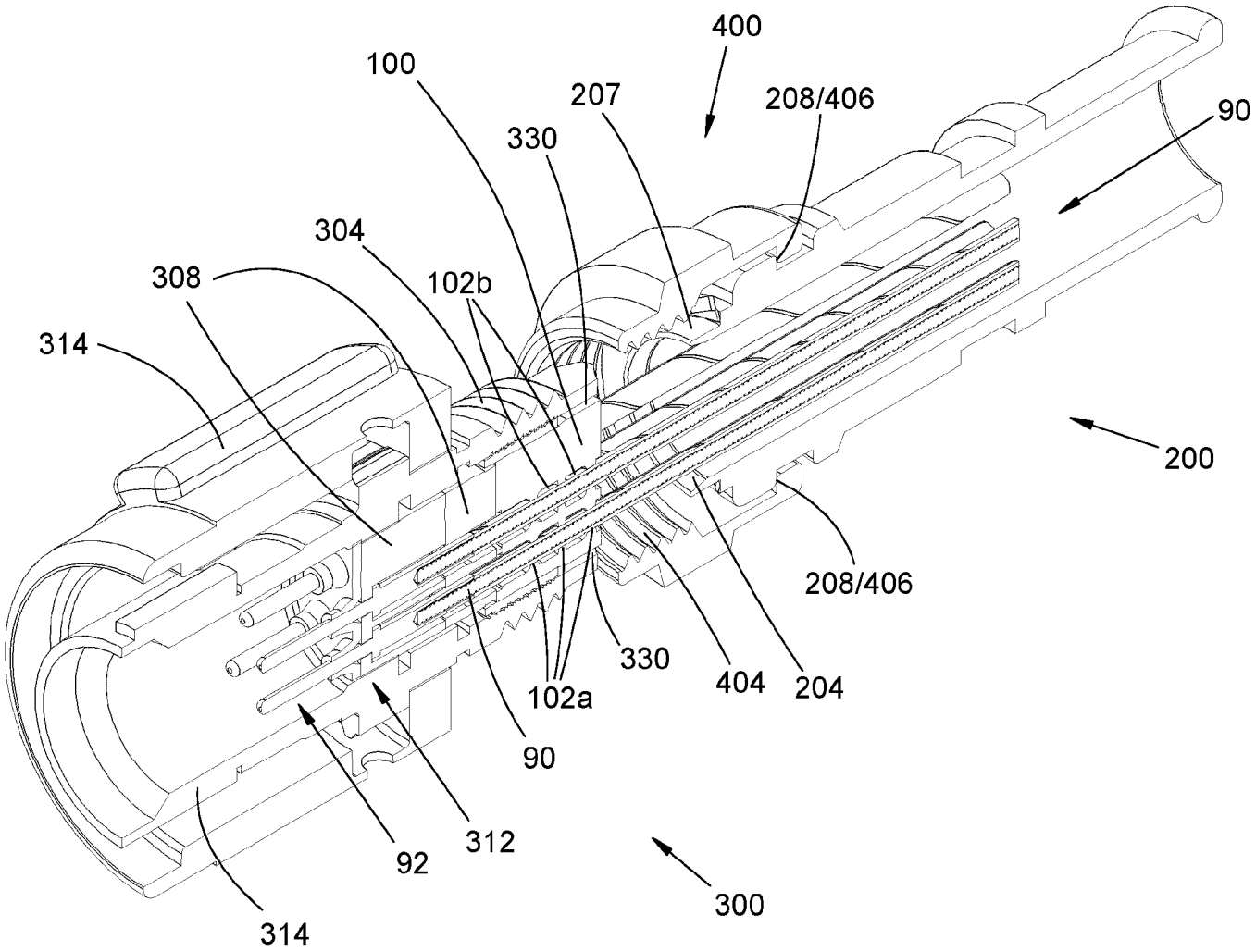
FIGS. 4 and 5 are isometric and side views, respectively, of a longitudinal cross section of the example inventive connector assembly with wires and contacts in a partly assembled arrangement.
Figure 5:
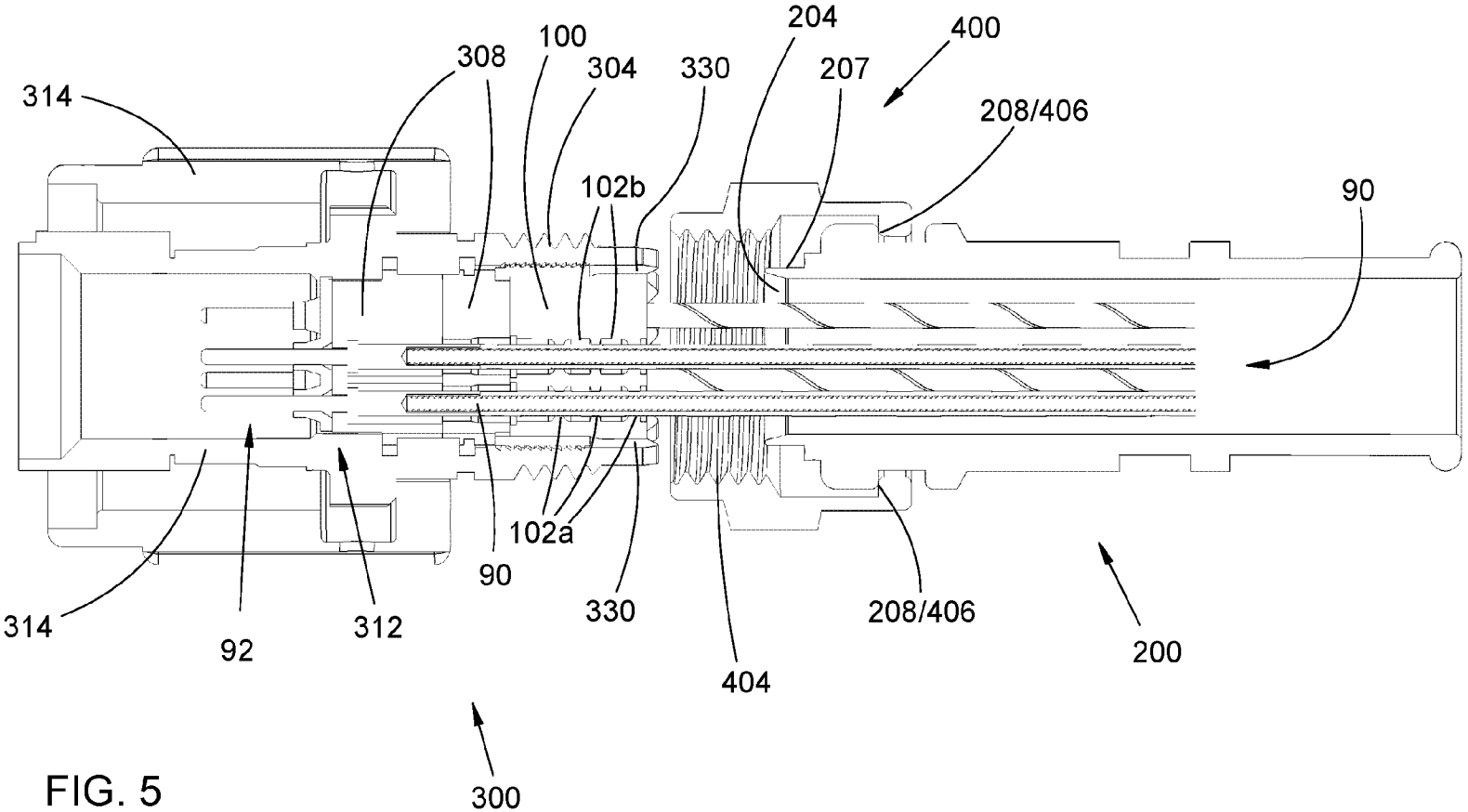
Figure 6:
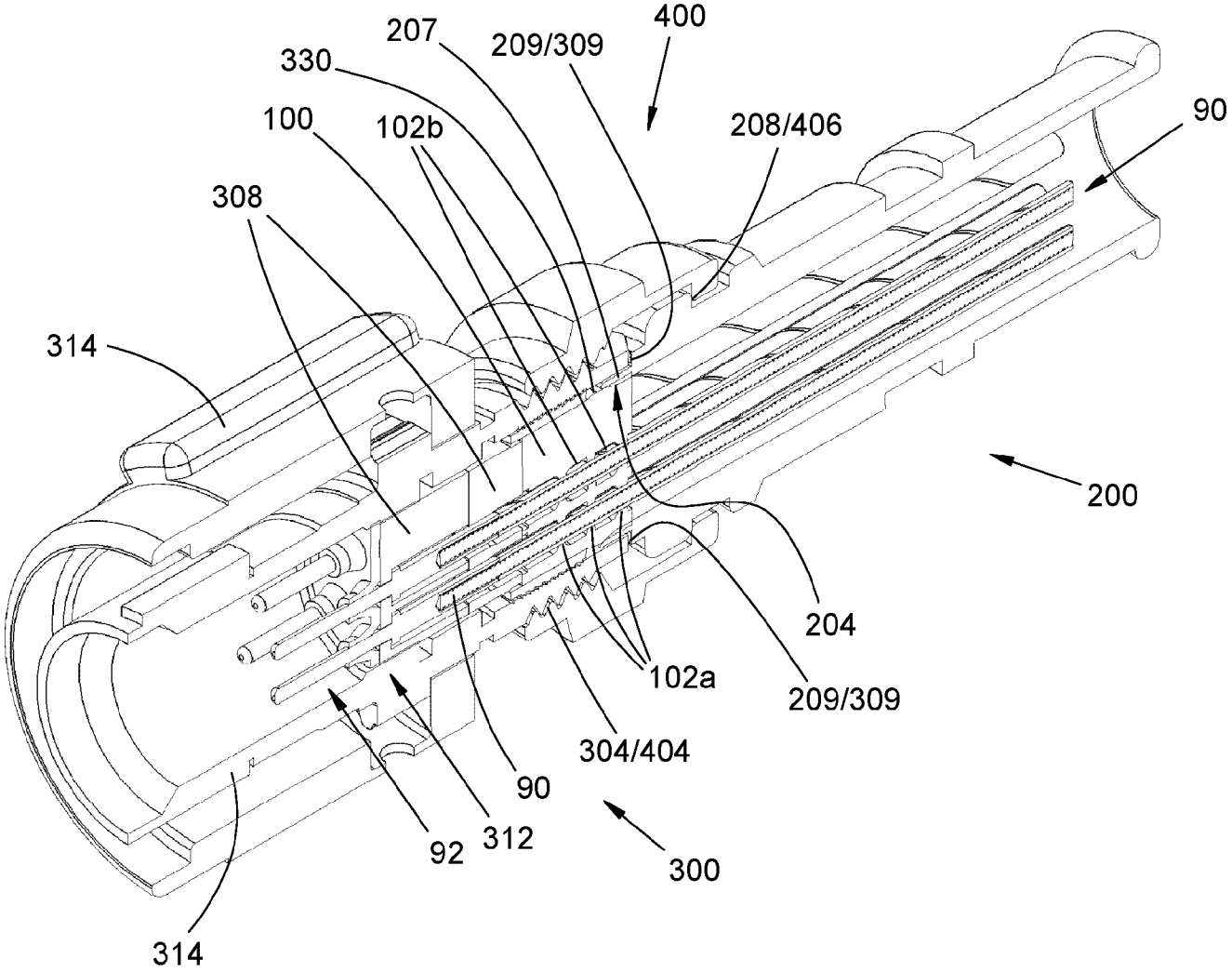
FIGS. 6 and 7 are isometric and side views, respectively, of a longitudinal cross section of the example inventive connector assembly with wires and contacts in a fully assembled arrangement.
Figure 7:
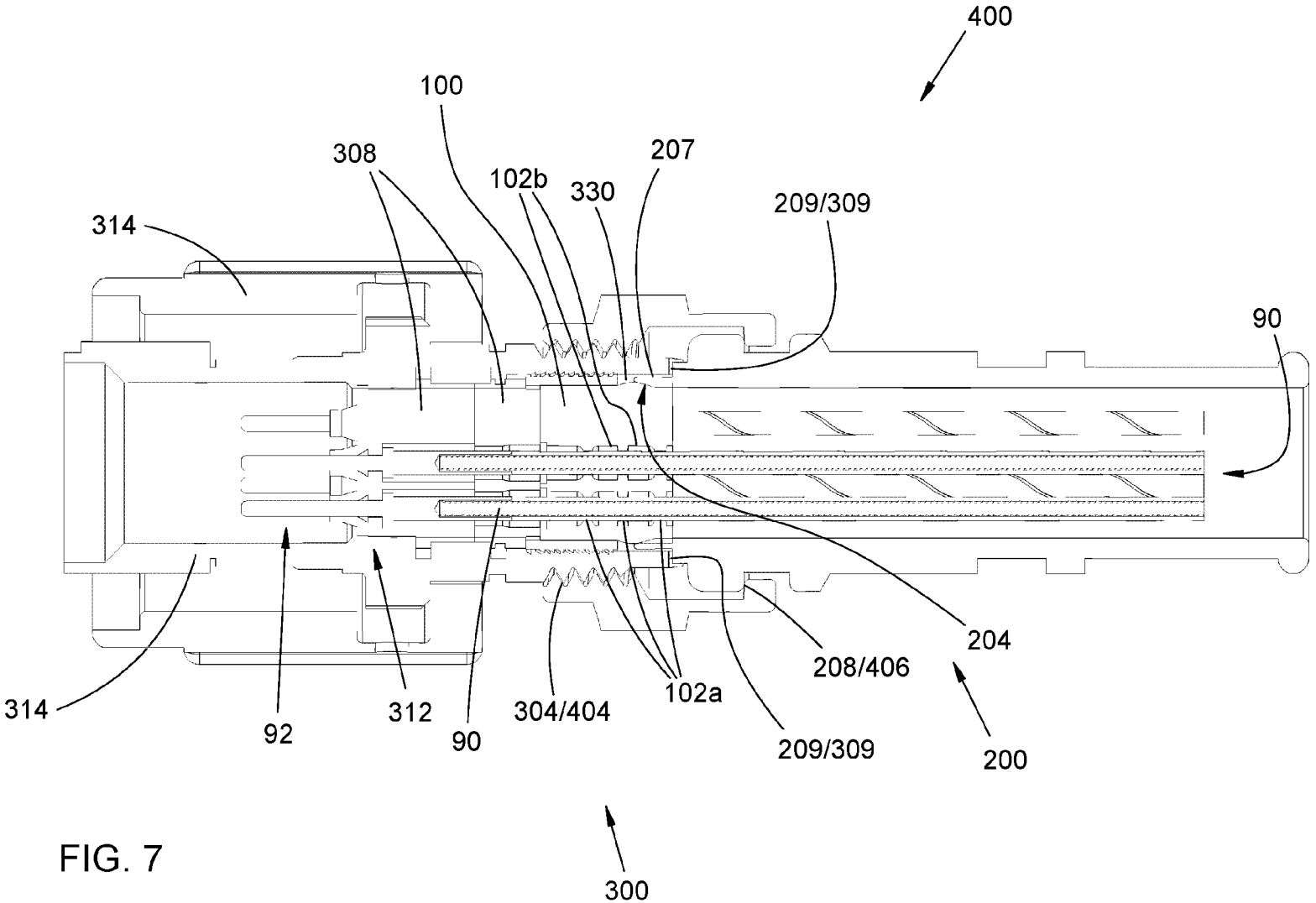
Figures 8A, 9A:
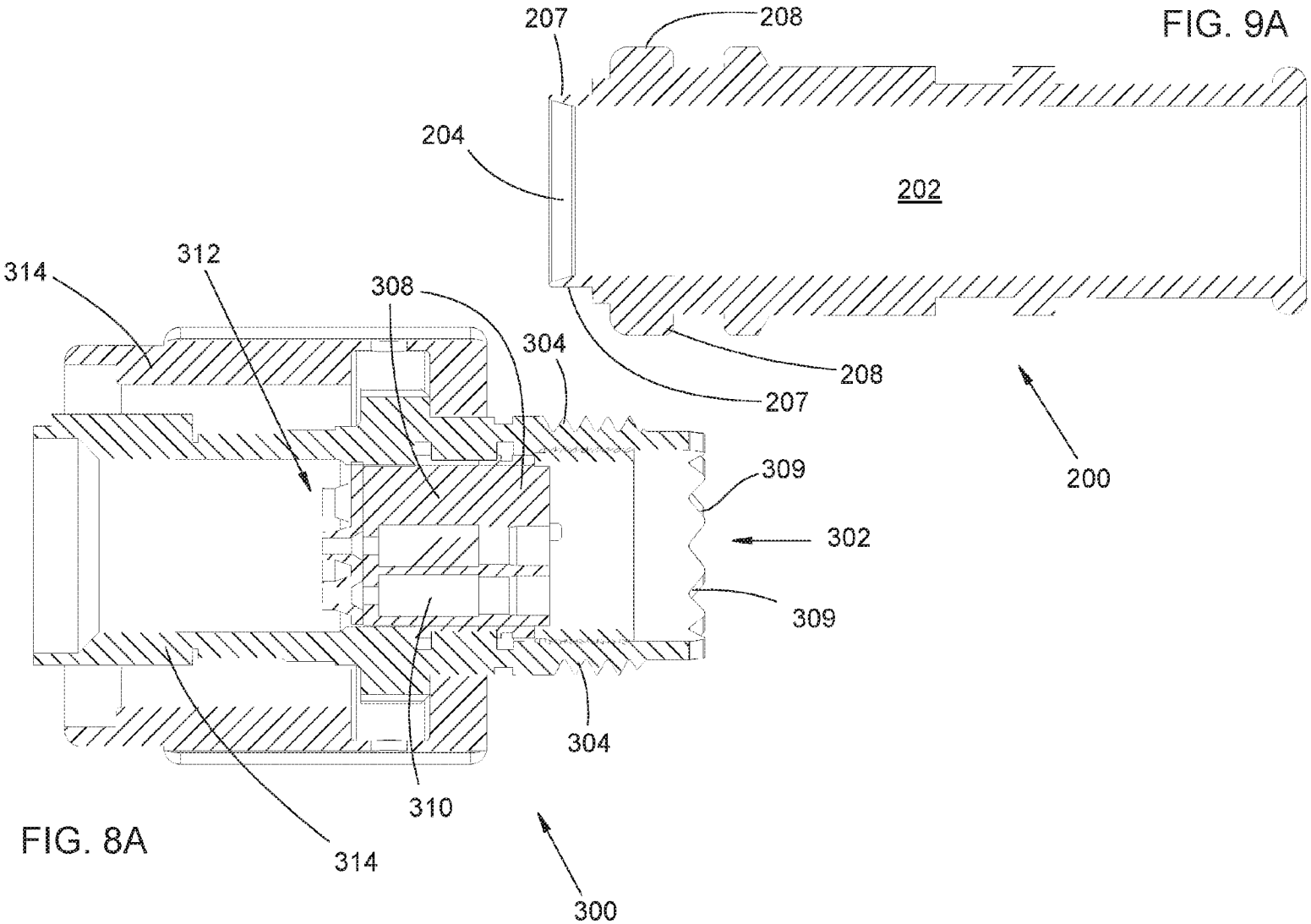
FIGS. 8A, 8B, and 8C are side cross-sectional, isometric cross-sectional, and isometric views of a front connector body of the example inventive connector assembly.
FIGS. 9A, 9B, and 9C are side cross-sectional, isometric cross-sectional, and isometric views of a rear connector body of the example inventive connector assembly.
Figures 8B, 8C:
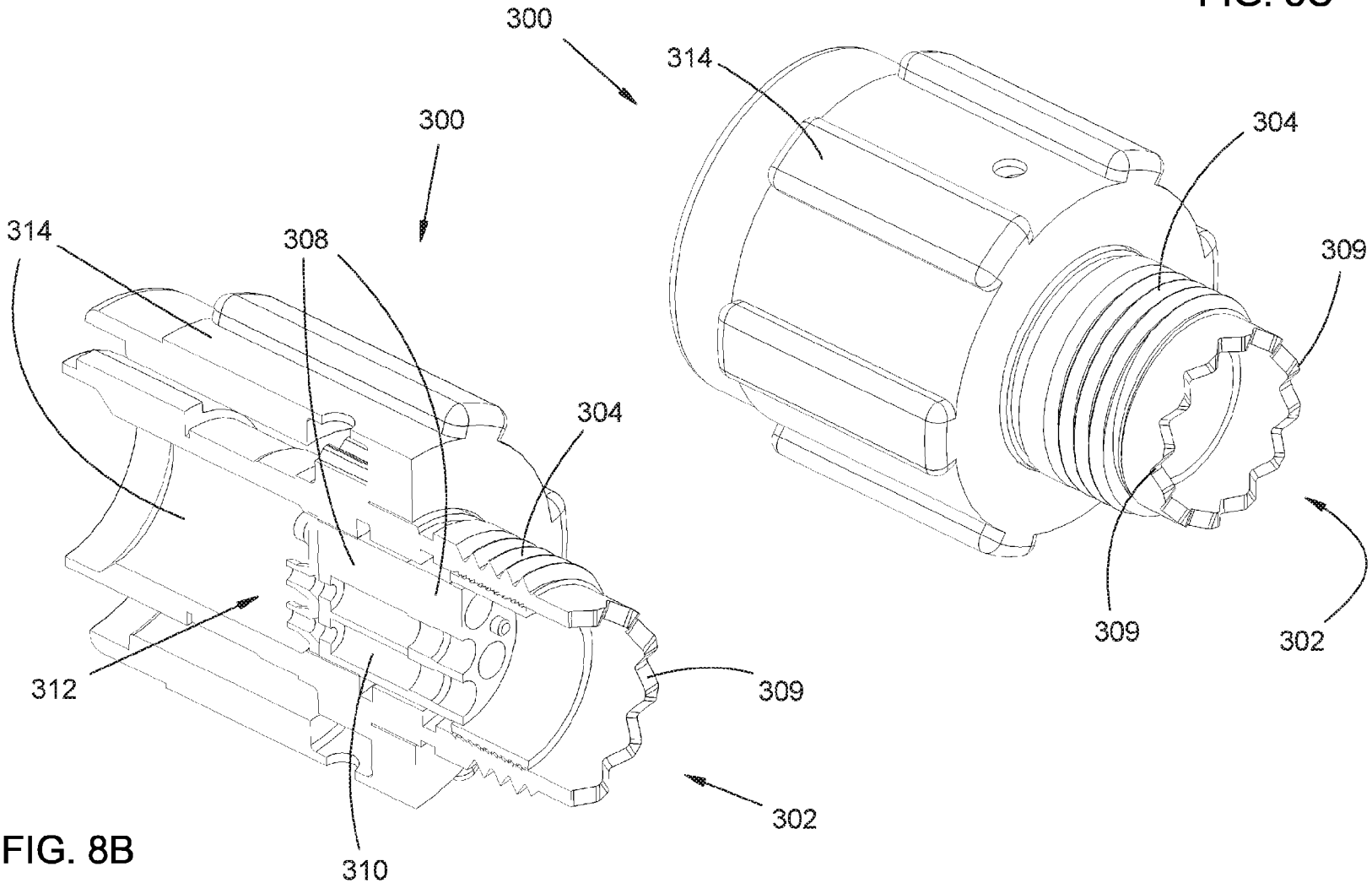
Figures 9B, 9C:
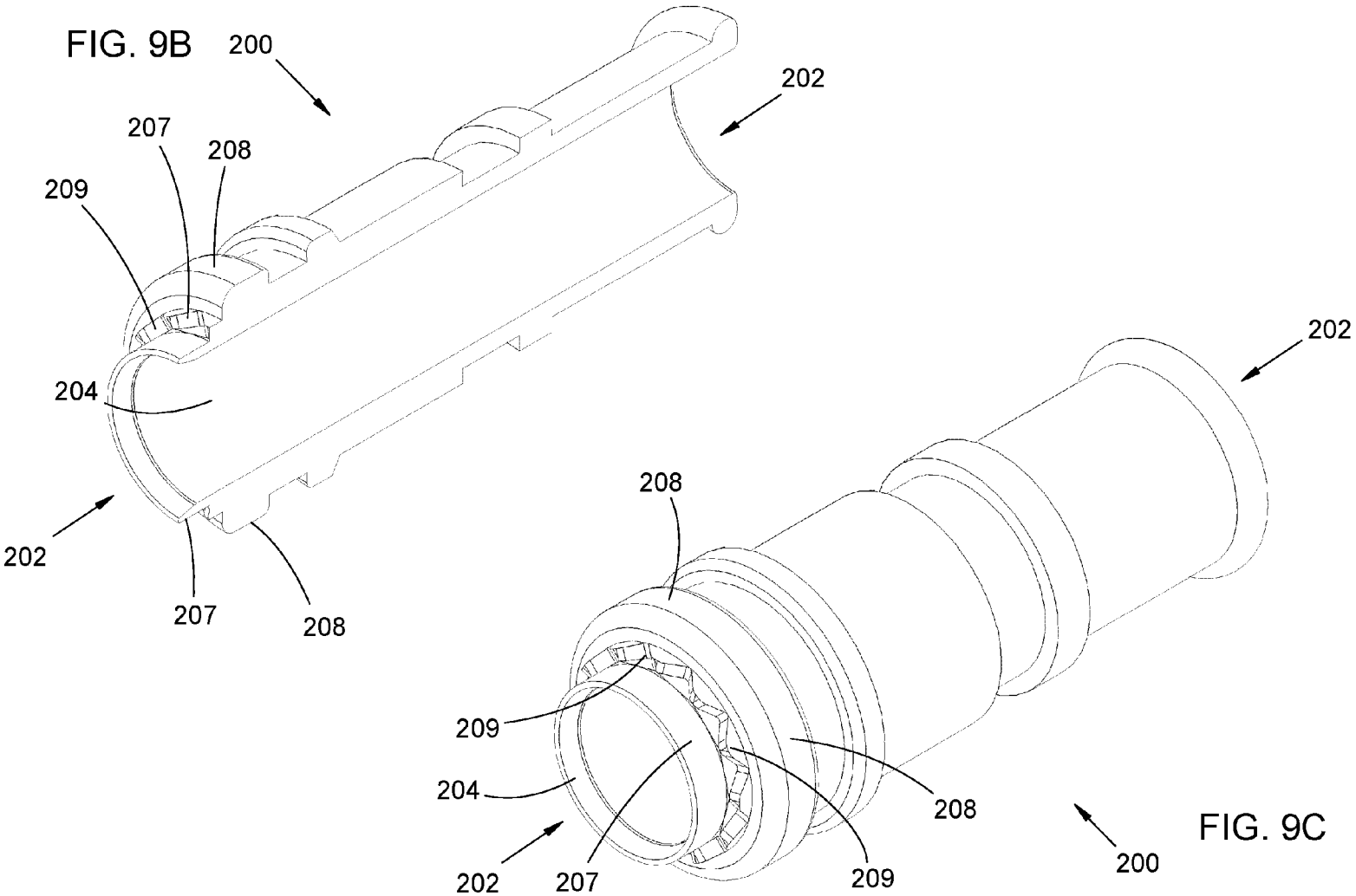
Figure 10B:
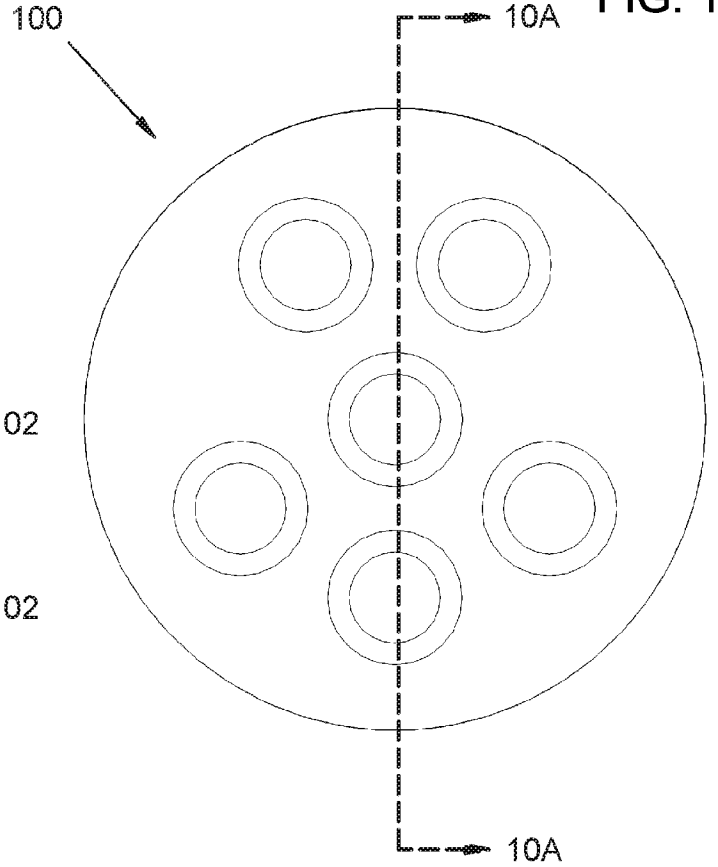
FIGS. 10A and 10B are side cross-sectional and rear views of a wire grommet of the example inventive connector assembly.
Figure 10A:
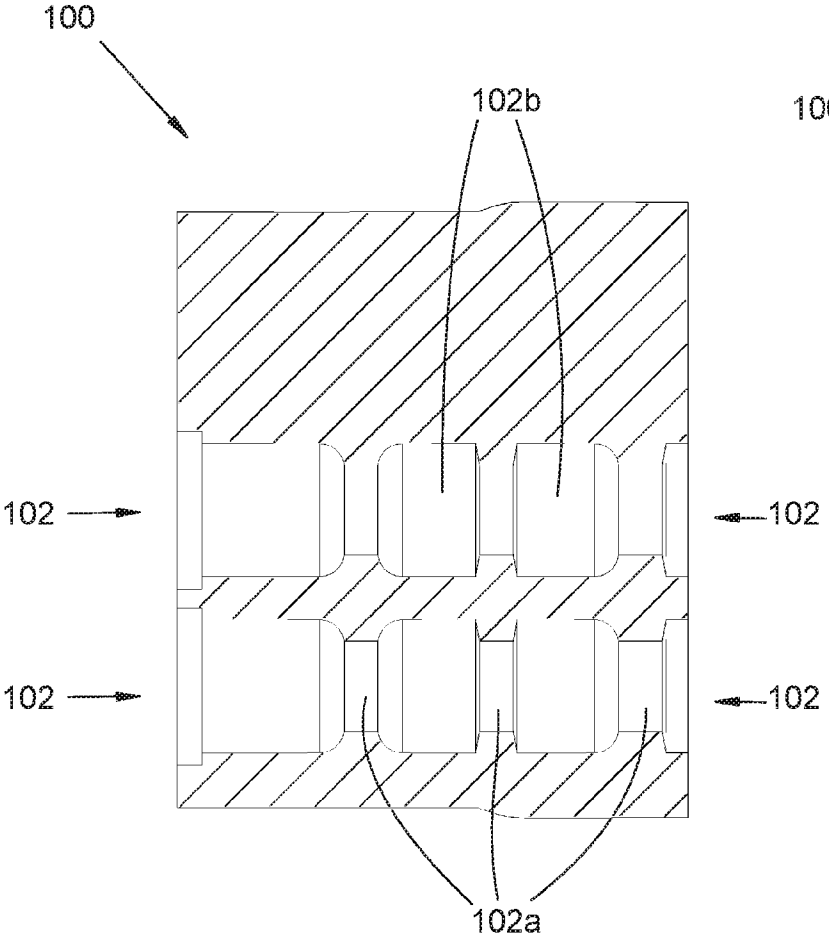
Figure 11B:
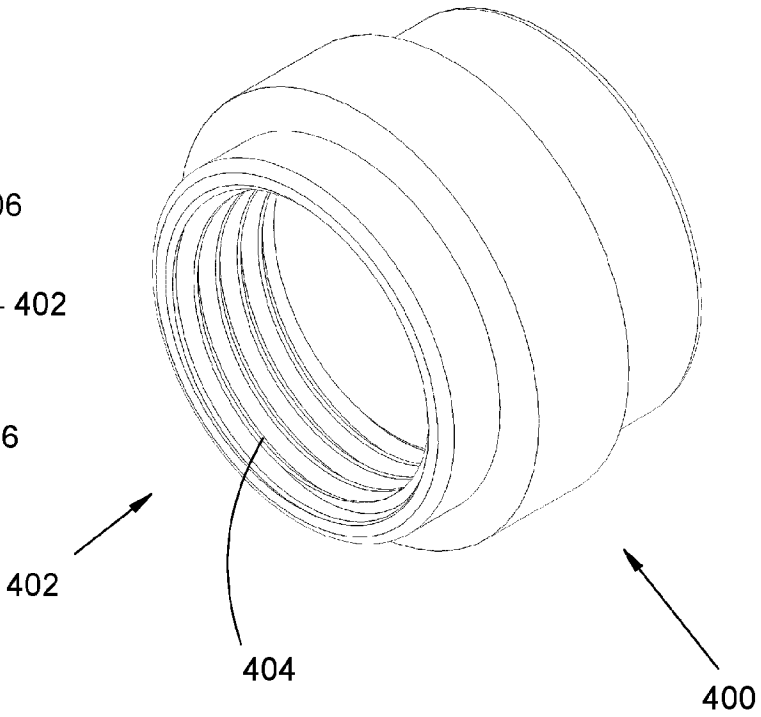
FIGS. 11A and 11B are side cross-sectional and isometric views of a nut of the example inventive connector assembly.
Figure 11A:
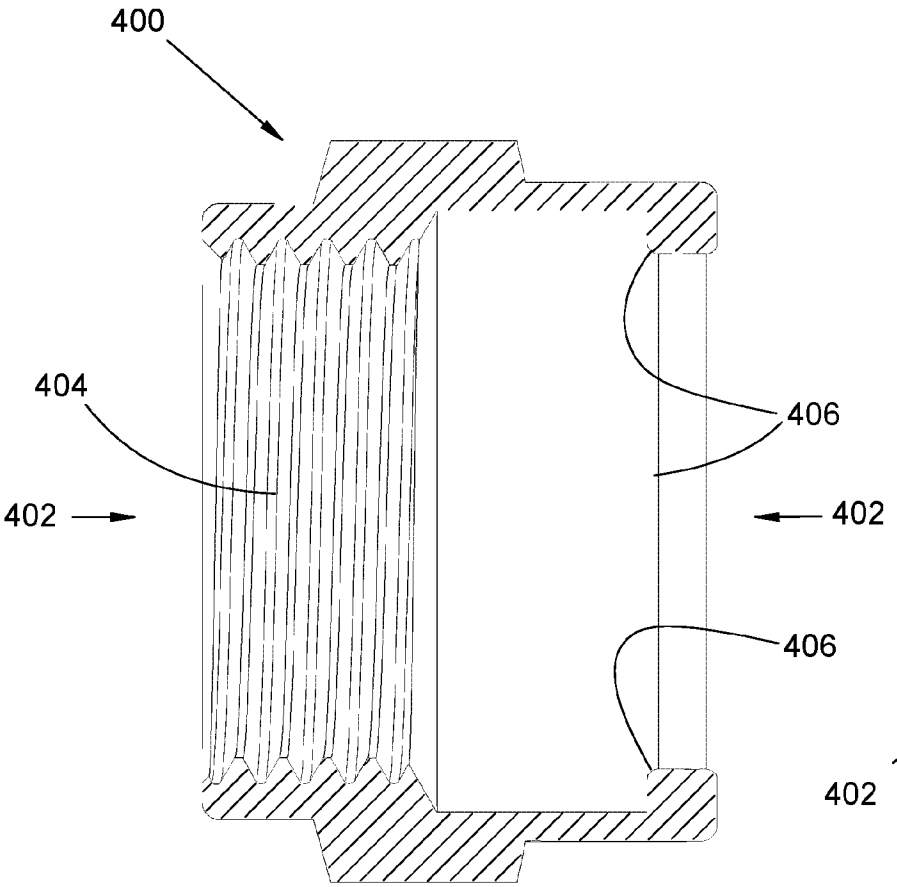

An example of an inventive connector assembly is shown in FIGS. 1-7 and comprises a substantially rigid front connector body 300 (FIGS. 8A-8C); a substantially rigid rear connector body 200 (FIGS. 9A-9C); a resiliently deformable wire grommet 100 (FIGS. 10A and 10B); and a threaded nut 400 (FIGS. 11A and 11B). The front connector body 300, the rear connector body 200, and the nut 400 can each comprise any one or more suitably rigid solid materials, including but not limited to: one or more metals or metal alloys; one or more plastics, resins, or polymers; one or more natural or synthetic fibrous materials; one or more other electrically conductive materials; or one or more other electrically insulating materials.

For purposes of the present disclosure and appended claims, directional terms such a front, forward, rear, rearward, and so forth are defined relative to the connector assembly, with "front" and the like being the direction from the connector assembly toward a mating connector assembly, and "rear" and the like being the opposite direction, i.e., toward one or more wires or a cable connected to the connector assembly. Any motion or movement recited in the disclosure, examples, or claims are relative motions or movements, e.g., forward movement of the rear connector body 200 toward the front connector body 300 is equivalent to rearward movement of the front connector body 300 toward the rear connector body 200.

The substantially rigid rear connector body 200 (also referred to as a connector accessory or as a connector backshell) has a rear axial passage 202 therethrough; the substantially rigid front connector body 300 (also referred to as a plug connector body in a plug-type connector assembly, or as a receptacle connector body in a receptacle-type connector assembly) has a front axial passage 302. In the example shown, the front connector body 300 is arranged in compliance with a MIL-DTL-38999 standard; any other suitable arrangement of the front connector body 300 can be employed, e.g., a front connector body arranged in compliance with an SAE AS50151 standard. While the inventive apparatus and methods disclosed or claimed herein can be implemented in a variety of connector types or arrangements, those inventive apparatus and methods may be particularly applicable when implemented with front connector bodies compliant with a MIL-DTL-38999 specification or an SAE AS50151 standard. The current versions of those specifications and standards (i.e., MIL-DTL-38999M dated 11 Feb. 2015 and SAE AS50151B dated 28 May 2013) are incorporated by reference as if fully set forth herein. When the connector assembly is connected to one or more wires 90 (six wires 90 in the examples shown; any suitable number of one or more wires can be employed) and assembled, a resiliently deformable wire grommet 100 is positioned within the front axial passage 302 and the wires 90 pass through the rear axial passage 202 and through corresponding wire passages 102 of the grommet 100. A forward portion of the front connector body 300 is structurally arranged so as to hold one or more electrical contacts 92 that are each connected to a corresponding wire 90. In the examples shown the electrical contacts 92 are pin contacts; in other examples the contacts are socket contacts. Any suitable number (one through 128 or more), type (e.g., pin or socket), or arrangement (e.g., square, rectangular, polygonal, or circular array or arrangement) of the one or more electrical contacts 92 can be employed in any type of connector assembly (e.g., plug, receptacle, bulkhead-mounted, wall-mounted, or cable-mounted). The wire grommet 100 serves to isolate the electrical contacts 92 and the conductive cores of the wires 90 from a use environment.

Any suitably rigid material can be employed for the front connector body 300 and the rear connector body 200, as noted above. In many example embodiments, the rear connector body 200 comprises a metal or metal alloy, so that the rear connector body 200 is electrically conducting and can serve to at least partly electromagnetically shield the one or more wires 90 passing through the rear axial passage 202. If the wires 90 are contained within a sheath (not shown) rearward of the connector assembly, that sheath can continue around a rearward portion of the rear connector body, if needed or desired. In some examples such a sheath can include conductive sheathing that serves as electromagnetic shielding for the wires 90, and electrical continuity can be established between such conductive sheathing and a conductive rear connector body 200 (e.g., by banding or crimping the conductive sheath onto the rear connector body 200). In some examples the sheath can include an outer insulating layer that continues around a rearward portion of the rear connector body 200 (e.g., plastic or elastomeric shrink tubing applied around the wires 90 and the rear connector body 200).

In many example embodiments, the front connector body 300 includes one or more metals or metal alloys, which can serve as electrical shielding in a manner similar to that described for the rear connector body 200, particularly if both front and rear connector bodies 300 and 200 include one or more metals or metal alloys and are in electrical contact with one another. The front connector body typically also includes one or more insulating materials arranged for holding the electrical contacts 92 in place without introducing unwanted electrical contact between them (i.e., without shorting them). In the example embodiment shown, the front connector body 300 includes an insulating body 308 (comprising, e.g., thermoplastic or other suitable insulating material) with wire channels 310 therethrough. Each wire channel 310 accommodates a corresponding one of the wires 90 and has a corresponding one of the electrical contacts 92 held at its front end. Additional structural members 312 can be employed to hold the electrical contacts 92 in place if needed or desired. A front end of the front connector body 300 can be structurally adapted in any suitable way to engage a mating connector assembly. In the example embodiment shown, the front connector body 300 includes mating hardware 314 for engaging a corresponding portion of a mating connector (not shown).

When the front and rear connector bodies 300 and 200 are assembled, a forward portion 207 of the front connector body 200 is received in a rearward portion of the interior of the front axial passage 302. In the example shown, the forward portion 207 extends forward beyond the tips of the teeth 209 so as to extend forward beyond the base portions of the teeth 309 when the front and rear connector bodies 300 and 200 are assembled with their respective teeth 309 and 209 engaged. In the example shown, engagement of the teeth 209 and 309 (triangular in this example; other suitable shapes can be employed) effects non-rotatable engagement of the front and rear connector bodies 300 and 200. In some other examples (e.g., as in the '580 application), the outer surface of the forward portion of the rear connector body 200 can include a set of one or more longitudinal splines, keys, or grooves, the inner surface of the rearward portion of the front axial passage 302 can include a set of one or more longitudinal splines, keys, or grooves, and engagement of the splines, keys, or grooves of the front and rear connector bodies 300 and 200 effects the non-rotatable engagement. Non-rotatable engagement prevents twisting of the wire grommet 100 or wires 90 by relative rotation of the connector bodies 300 and 200 (e.g., induced by tightening the threaded nut 400; discussed further below). The term "non-rotatable" as used herein shall include arrangements wherein only limited or constrained relative rotation, or no rotation, of the front and rear connector bodies 300 and 200 might occur. For example, initial engagement of the triangular teeth 209 and 309 still permits limited relative rotation, but it is not until the teeth are fully engaged (i.e., "bottomed out") that relative rotation is substantially prevented. Both initial and full engagement of the teeth 209 and 309 are encompassed by the term "non-rotatable engagement."

The nut 400 includes a central opening 402 and internal threads 404. The nut 400 is structurally arranged so as to receive through the central opening 402 a rearward portion of the rear connector body 200 and to obstruct rearward movement of the forward portion of the rear connector body 200 through the central opening 402. In the example embodiment shown, an outward circumferential flange 208 of the rear connector body 200 is too large to pass an inward circumferential flange 406 of the nut 400; other suitable structural arrangements can be employed. A rearward portion of the front connector body 300 includes external threads 304 that engage the internal threads 404 of the nut 400. Tightening of the nut 400 threadedly engaged on the rearward portion of the front connector body 300 (via threads 304/404) results in forward movement of the nut 400 and the rear connector body 200 toward the front connector body 300 and concomitant forward movement of the forward portion 207 of the rear connector body 200 into the rearward portion of the front axial passage 302. Fully tightening the nut 400 results in fully engaged assembly of the connector bodies 300 and 200 at the forward limit of forward movement of the rear connector body 200 and the nut 400 (e.g., with the teeth 209 and 309 engaged in the example shown). In some examples (e.g., in the example shown in the '580 application), contact between the flange 208 of the rear connector body 200 and a rear end of the front connector body 300 limits the forward movement.

The resiliently deformable (i.e., elastically deformable) wire grommet 100 has a substantially cylindrical outer surface and one or more axial wire passages 102 therethrough. Each wire passage 102 includes two or more wire-sealing segments 102*a* (also referred to as glands). Each wire passage 102 typically also includes an intervening, transversely enlarged, internal chamber 102*b* between each adjacent pair of wire-sealing segments 102*a* along each wire passage 102; such enlarged chambers 102*b* can facilitate insertion of the wires 90 through the corresponding passages 102 (e.g., by providing space to accommodate displacement of compressed grommet material from adjacent wire-sealing segments 102*a*) without unduly compromising the sealing of each wire 90 by the corresponding passage 102. Each wire-sealing segment 102*a* is sized and shaped so as to (i) enable a corresponding wire 90 to be inserted through the corresponding wire passage 102 and (ii) form a seal around the corresponding inserted wire 90. Typically this is achieved by making the wire-sealing segments 102*a* slightly smaller than the thickness of the wire 90. Resilient stretching of each wire-sealing segment 102*a* enables the slightly over-sized wire 90 (and in some examples a wire-containing tube of an insertion/removal tool) to be inserted through the passage 102; resilient rebound of each wire-sealing segment 102*a* creates seal around the corresponding wire 90. Exactly how much smaller than the wire thickness are the wire-sealing segments can vary and typically is determined by the properties of the resilient grommet material, the surface characteristics of the wire insulation, the cross-sectional shapes of the wires 90 and the wire-sealing segments 102*a* (see below), the size of a wire-containing tube of an insertion/removal tool (if employed), the amount of radial compression of the wire grommet by the rear connector body (discussed further below), and the tightness of the seal needed or desired in a given use environment (i.e., to achieve operationally acceptable sealing). Any suitable size differential can be employed that enables insertion of the wires 90 through the wire passages 102 and also results in an operationally acceptable seal around the wires 90.

Typical resiliently deformable materials for wire grommet 100 include, but are not limited to: synthetic or natural rubber; silicone or fluorosilicone elastomer; fluorocarbon elastomer (e.g., Viton®); ethylene propylene diene monomer (EPDM) elastomer; neoprene; other resiliently deformable polymer or resin; or other suitable resiliently deformable material. In some example embodiments the grommet 100 or the front axial passage 302 can further include a rotational indexing structure (e.g., one or more mating longitudinal grooves, keys, or splines) arranged to permit insertion of the grommet 100 into the front axial passage 302 in only one relative orientation about a longitudinal axis. In some other examples, the wires 90 passing through the passages 102 and corresponding passages through the insulating body 308 effects rotational alignment of the wire grommet 100 within the front axial passage 302 of the front connector body 300. In some examples, the grommet 100 can be attached or secured to the front connector body 300 within the front axial passage 302, e.g., by adhesive or a mechanical retaining member such as a snap ring or threaded retaining ring. In other examples, the grommet 100 is not secured or attached to the front connector body 300, but is held in place by the engagement of the front and rear connector bodies 300 and 200 with each other.

Any suitable cross-sectional shape can be employed for the wire-sealing segments 102*a*. In some example embodiments each wire-sealing segment 102*a* has a substantially circular cross section to accommodate a corresponding wire also having a circular cross section. A circular cross section for the wire-sealing segments 102*a* can be employed in some example embodiments with non-circular wires 90 (e.g., oval or elliptical cross sections), so as to eliminate the need to rotationally orient the non-circular wire 90 before inserting it into the corresponding wire passage 102. In still other example embodiments, non-circular wire-sealing segments 102*a* can be employed having a shape corresponding to a non-circular shape of the wires 90, with the wires 90 being properly oriented before insertion through the wire passages 102.

In many common instances, resiliency of the grommet 100 and the size or shape differential between the wire-sealing segments 102*a* and the wires 90 may not result in a sufficiently good seal around the wires 90. Such instances can arise more frequently when non-circular wires 90 are employed with a grommet 100 having substantially circular wire-sealing segments 102*a* of the wire passages 102. Oval or elliptical wire cross sections arising from current wire manufacturing processes are increasingly common. Poor sealing can also arise with wires have insulation in the form of a spiral-wound tape, which results in a spiral ridge on the outer surface of the wire where each turn of the insulating tape overlaps an adjacent turn. That ridge can provide a path for moisture or other contaminants to enter the connector. It therefore would be desirable to provide enhanced sealing of the wires 90 by the grommet 100.

In the inventive connector assemblies disclosed herein, the rear connector body 200 is structurally adapted so as to provide, upon fully engaged assembly of the connector assembly, radial compression, within the interior of the front axial passage 302 of the front connector body 300, of the wire grommet 100 over a portion of its length, including radial compression of one or more of the wire-sealing segments 102*a*. The front connector body 300 can also be so adapted in some instances, but in many instances the front connector body 300 is of a conventional arrangement (e.g., arranged in compliance with a MIL-DTL-38999 specification or an SAE AS50151 standard), with the inventive features of the connector assembly residing primarily in the arrangement of the rear connector body 200. Both connector bodies 200 and 300 can be provided by the same manufacturer or by different manufacturers; in the latter instances (i.e., a conventional front connector body 300 paired with an inventive rear connector body 200) the front and rear connector bodies 300 and 200 may often be provided by different manufacturers. In the example of the '580 application, both the front and rear connector bodies 300 and 200 are structurally adapted so as to provide, upon fully engaged assembly of the connector assembly, radial compression of the wire grommet 100 over a portion of its length that includes two or more of the wire-sealing segments 102*a* of each wire passage 102. In both the present application and the '580 application, it is the radial compression, particularly of at least one wire-sealing segments 102*a* (present application), or two or more wire-sealing segments 102*a* ('580 application), of the of each wire passage 102, that provides the desired enhanced sealing of the wires 90 by the grommet 100, even when non-circular wires 90 and circular wire-sealing segments 102*a* are employed, or even when wires 90 having spiral-wound insulation are employed.

To achieve the inventive arrangement, the front end of the rear axial passage 202 is large enough to receive therein a rearward portion of the grommet 100 without substantial radial compression of the grommet 100, and the rear axial passage 202 includes a rearward-tapered segment 204 (referred to hereafter as the tapered segment 204). The tapered segment 204 of the rear axial passage 202 is structurally arranged so as to receive therein the rearward portion of the grommet 100, engage its outer surface, and compress it radially along with radially compressing one or more of the wire-sealing segments 102*a* of each wire passage 102 within the grommet 100. At least portions, including a rearward portion, of the front axial passage 302 are structurally arranged so as to receive therein at least the forward portion of the grommet 100 without substantial radial compression of the grommet 100. In the inventive connector assemblies disclosed or claimed herein, the forward portion 207 of the rear connector body 200, including at least a portion of the tapered segment 204 of the rear axial passage 202, is structurally arranged to extend into and fit within the rearward portion of the front axial passage 302, interposed between the rearward portion of the grommet 100 and an inner surface of the rearward portion of the front axial passage 302.

An inventive connector assembly arranged according to the present disclosure or appended claims is thus structurally arranged so that tightening the nut 400 drives forward portion 207 and the tapered segment 204 of the axial passage 202 forward into the rearward portion of the front axial passage 302 wedged between the inner surface of the front axial passage 302 and the outer surface of the grommet 100. The wedge action of the tapered segment 204 on the outer surface of the grommet 100 results in radial compression of the rearward portion of the grommet 100 and one or more of the wire-sealing segments 102*a* of each wire passage 102 therein. In some examples (e.g., the example shown in the '580 application), two or three or more wire-sealing segments can be radially compressed by the wedge action, on the outer surface of the grommet 100, of the tapered segment 204 of the rear axial passage 202. The non-rotatable engagement of the front and rear connector bodies 300 and 200 (e.g., by engagement of the teeth 209 and 309) reduces or prevents torsional strain or twisting of the wire grommet 100 by the engaged tapered segment 204 as the rear connector body 200 is driven forward by tightening the nut 400. Such twisting or torsional strain can result in various undesirable effects, such as excessive resistance to tightening the nut 400, disruption of the sealing of the wire-sealing segments 102*a* around the wires 90, twisting or breakage of the wires 90, or structural failure of the wire grommet 100.

The grommet 100 comprises a resiliently deformable material to enable radial compression by the tapered segment 204 of the rear axial passage 202. However, such resilient materials are not necessarily particularly compressible; radial compression of the rearward portion of the grommet 100 typically causes a portion of the grommet 100 forward of the compressed portion to bulge outward, i.e., to expand radially. In some examples, a forward portion of the tapered segment 204 of the rear axial passage 202 can be structurally arranged so as to accommodate that radial expansion, e.g., by having a radius at its forward end that is larger than the radius of the grommet 100 in its uncompressed state. In some examples, at the forward limit of the forward movement of the rear connector body 200 toward the front connector body 300, a gap remains at a front end of the rear connector body 200 that can accommodate the radial expansion of that portion of the grommet 100 forward of the radially compressed rearward portion of the grommet 100. In some of those latter examples, a resilient sealant 330 can partly fill the gap.

Figure 12:
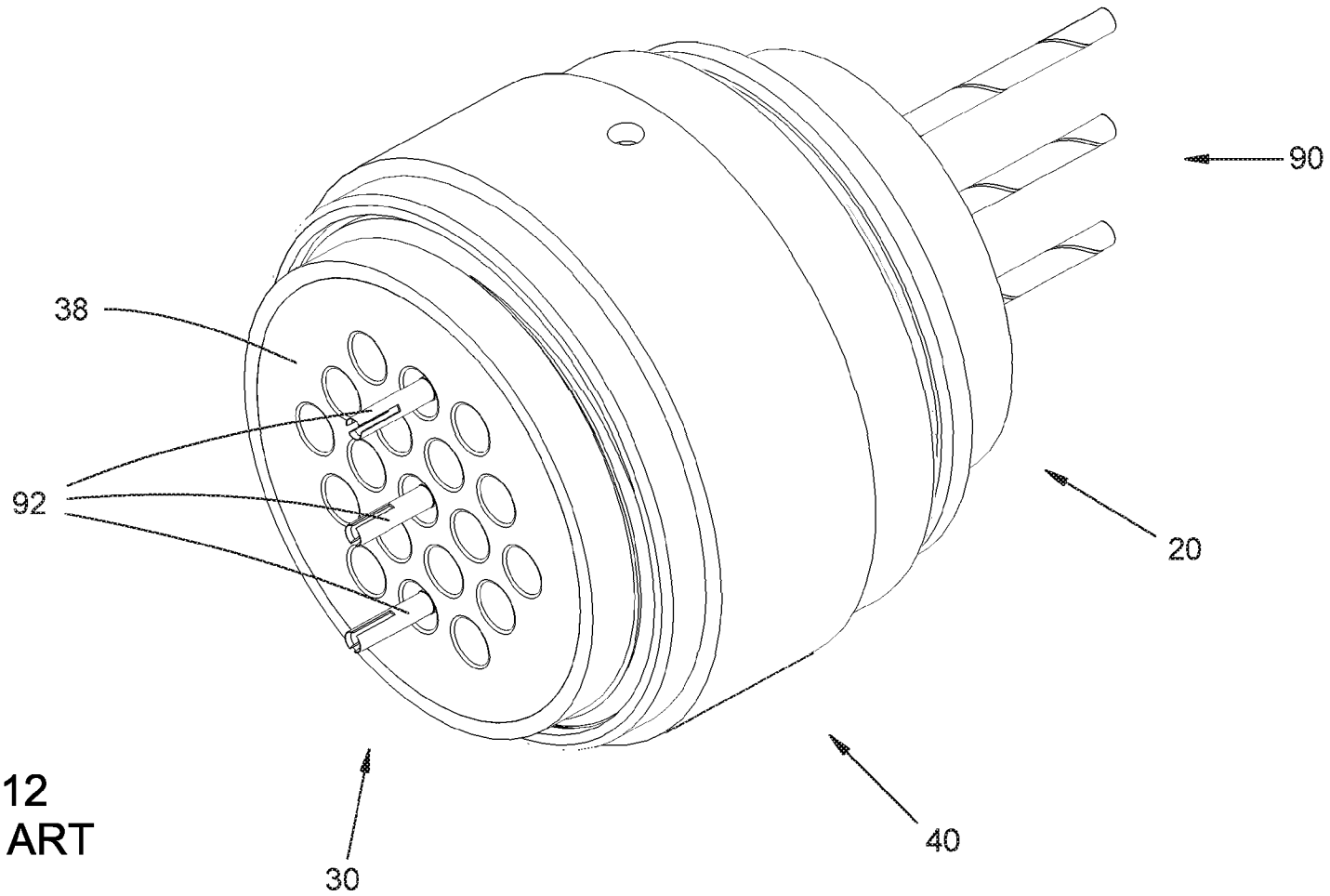
FIG. 12 PRIOR ART
FIG. 12 is an isometric view of an example of a conventional sealed electrical connector assembly with wires in a fully assembled arrangement.
Figure 13:
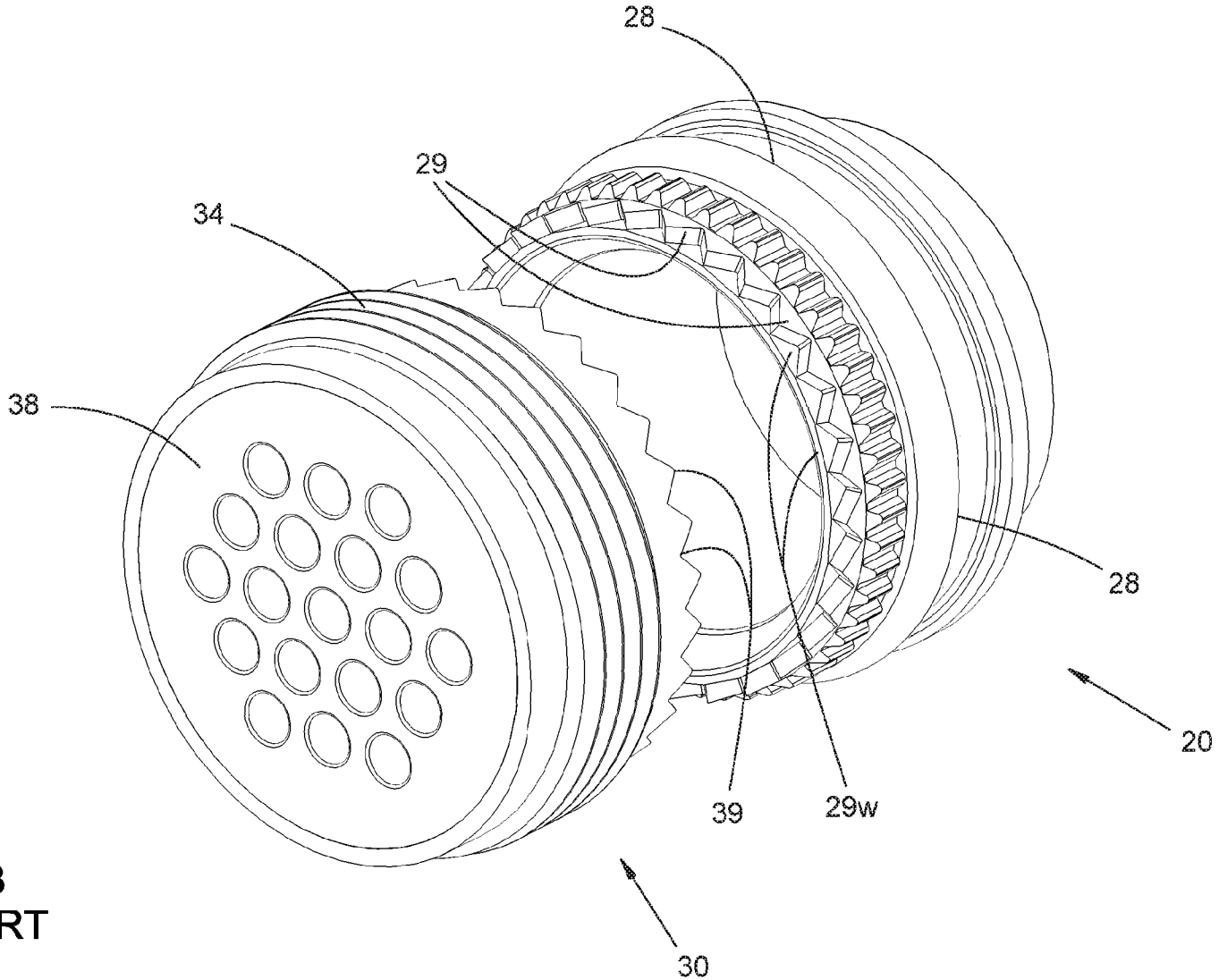
FIG. 13 PRIOR ART
FIG. 13 is an isometric view of front and rear connector bodies of the example conventional connector assembly.
Figure 14:
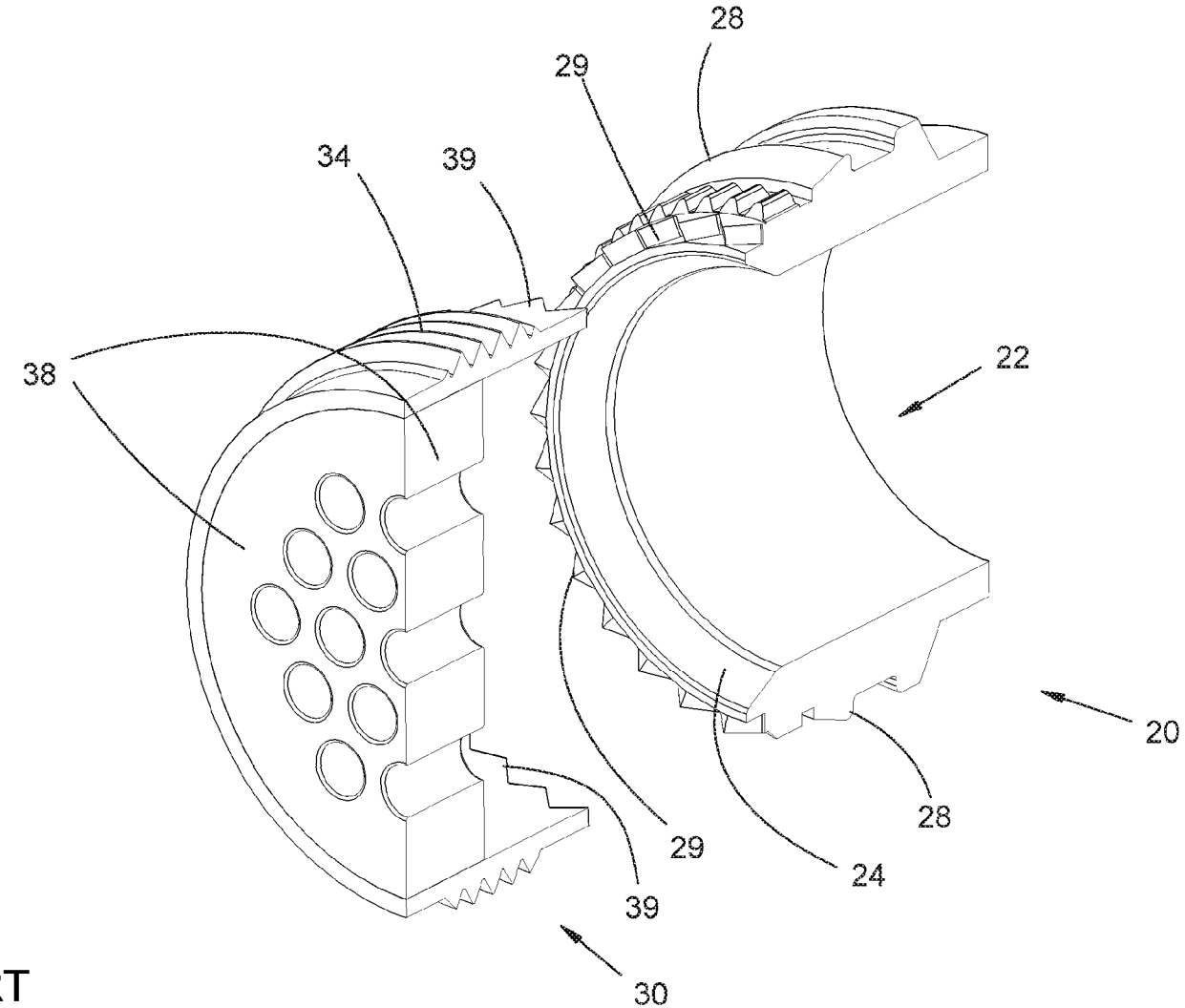
FIG. 14 PRIOR ART
FIG. 14 is an isometric view of a longitudinal cross section of the front and rear connector bodies of the example conventional connector assembly.
Figure 15:
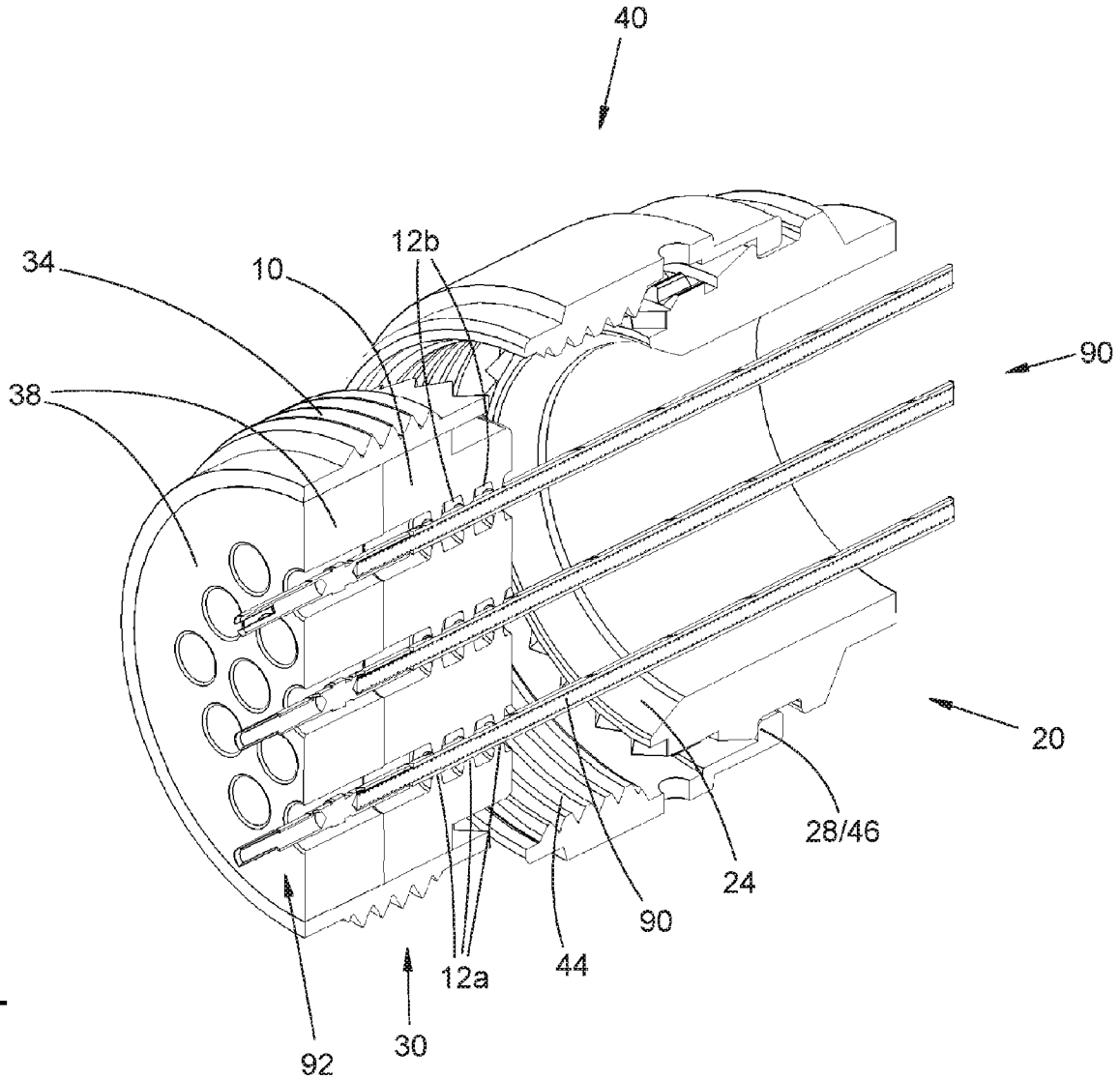
FIG. 15 PRIOR ART
FIGS. 15 and 16 are isometric and side views, respectively, of a longitudinal cross section of the example conventional connector assembly with wires and contacts in a partly assembled arrangement.
Figure 16:
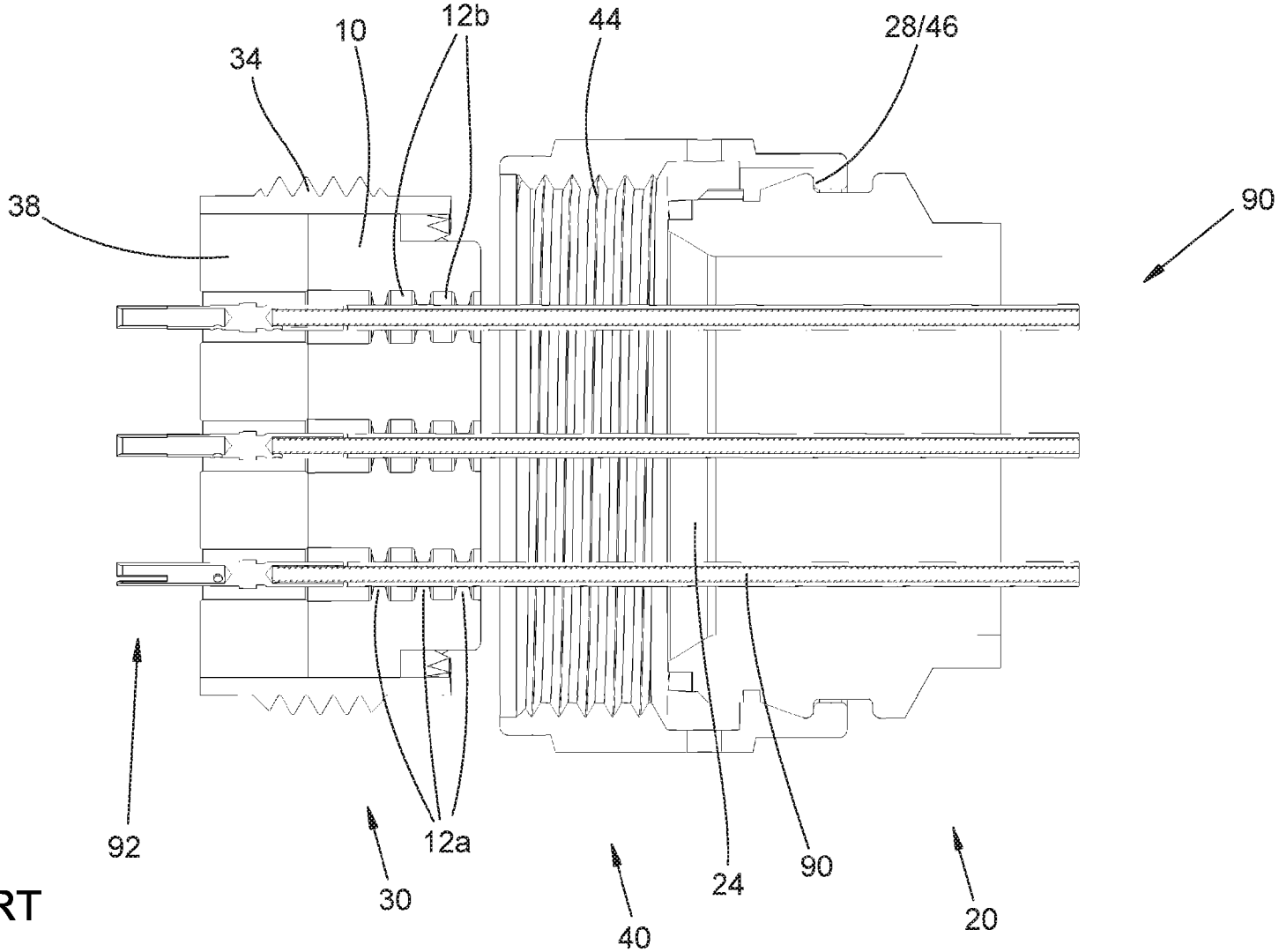
FIG. 16 PRIOR ART
Figure 17:
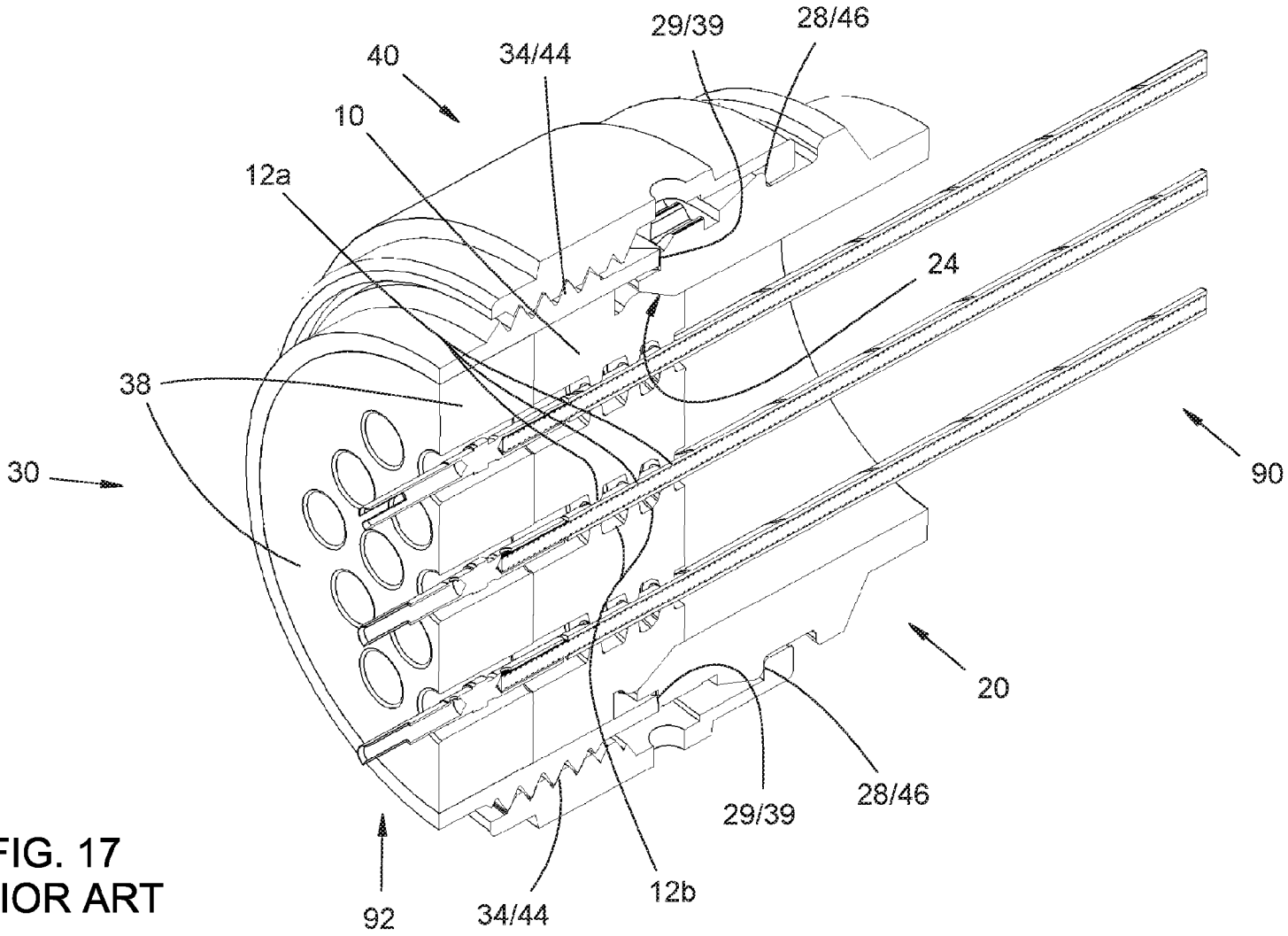
FIG. 17 PRIOR ART
FIGS. 17 and 18 are isometric and side views, respectively, of a longitudinal cross section of the example conventional connector assembly with wires and contacts in a fully assembled arrangement.
Figure 18:
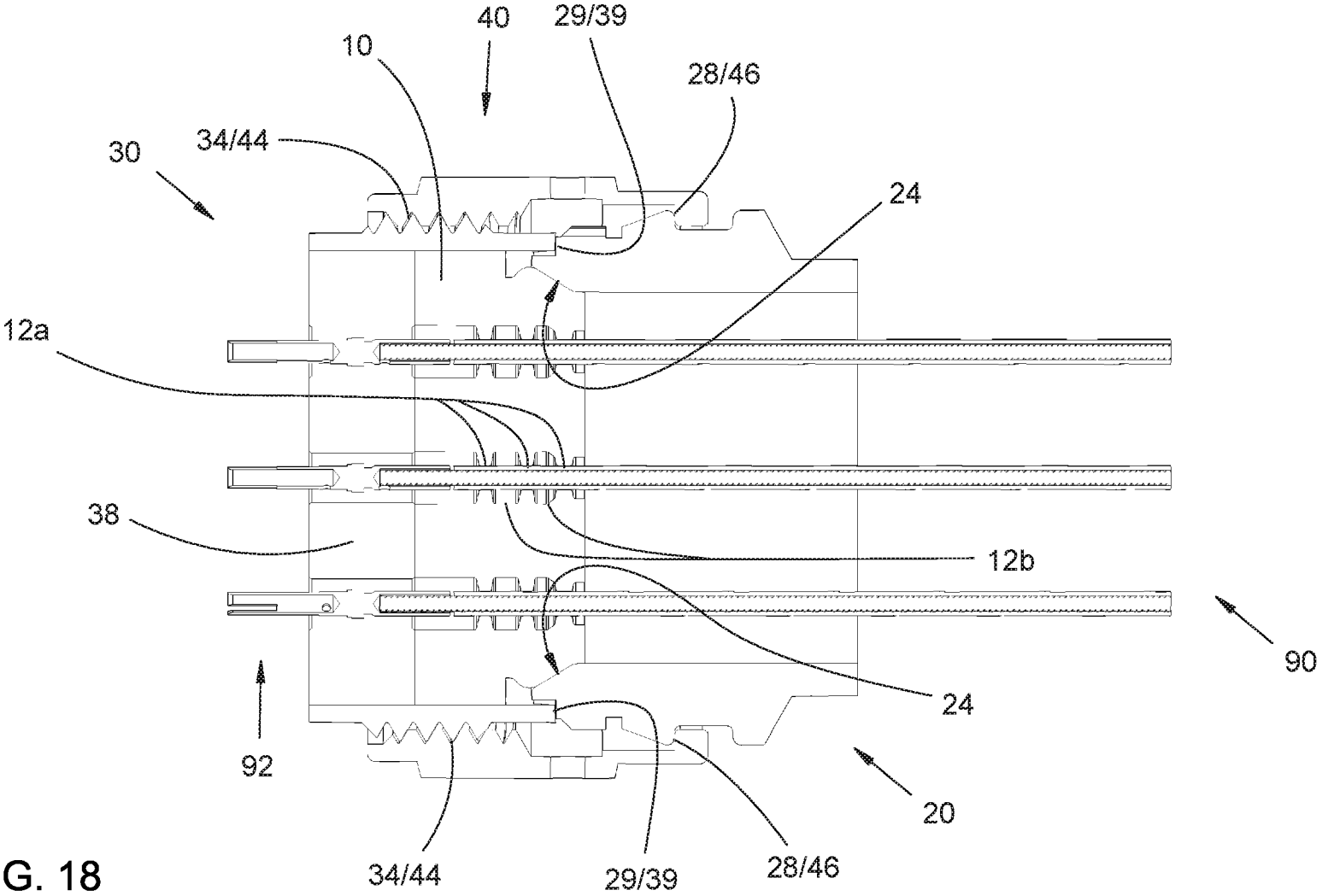
FIG. 18 PRIOR ART

In some examples, the connector assembly further comprises a resilient O-ring (e.g., as in FIGS. 12-14 of the '580 application). At the forward limit of the forward movement of the rear connector assembly 200, engagement of the O-ring between the outer surface of the forward portion of the rear connector body 200 (e.g., just forward of the flange 208) and the inner surface of the rear portion of the front axial passage 302 serves to establish a seal to substantially isolate from the use environment the rear portion of the front axial passage 302. The seal provided by the O-ring is in addition to that provided by the grommet 100 and its radial compression by the tapered segment 204 of the rear axial passage 202. In examples that include splines, the splines typically are arranged or positioned so as not to interfere with sealing provided by the O-ring 340.

An example method employing an inventive connector assembly, e.g., such as the example shown in FIGS. 1-7, comprises: (a) inserting each one of a set of one or more wires 90 through the wire grommet 100 through a corresponding one of the one or more wire passages 102; (b) securing one or more corresponding electrical contacts 92, connected to the forward ends of the wires 90, to be held by the forward portion of the front connector body 300; (c) inserting the grommet 100 into the front axial passage 302; (d) engaging the front and rear connector bodies 300 and 200; (e) threadedly engaging the nut 400 and the front connector body 300; (f) tightening of the nut 400 threadedly engaged on the rearward portion of the front connector body 300, thereby resulting in forward movement of the nut 400 and the rear connector body 200 toward the front connector body 300, forward movement of the non-rotatably engaged forward portion 207 of the rear connector body 200 into the rearward portion of the front axial passage 302, rearward movement of the rearward portion of the grommet 100 into the tapered segment 204 of the rear axial passage 202, and radial compression, by the tapered segment 204 of the rear axial passage 202, of the rearward portion of the grommet 100 and one or more of the wire-sealing segments 102*a* of each wire passage 102 therein. Typically, but not necessarily, the contacts 92 are connected to the wires 90 before the wires 90 are inserted through the wire grommet 100; typically, but not necessarily, the contacts 92 are connected to the wires 90 before the contacts 92 are secured to be held by the front connector body 300.

In some examples of such a method, the one or more wires 90 are inserted through the wire grommet 100 before inserting the wire grommet 100 into the front axial passage 302. In those instances, the wires 90 serve to align the wire passages 102 with corresponding wire passages in the front connector body 300. In other examples of such methods, the one or more wires 90 are inserted through the wire grommet 100 after inserting the wire grommet 100 into the front axial passage 302. In those instances, an insertion/removal tool is used that comprises a tube arranged (i) to receive therein one of the one or more wires 90, (ii) to be inserted along with the wire 90 through the corresponding one of the one or more wire passages 102, and (iii) to be withdrawn from the corresponding wire passage 102 leaving the wire 90 within the corresponding wire passage 102.

In addition to the preceding, the following examples fall within the scope of the present disclosure or appended claims:

Example 1

A connector assembly comprising: (a) a resiliently deformable wire grommet having a substantially cylindrical outer surface and one or more axial wire passages therethrough, wherein each wire passage includes two or more wire-sealing segments and each wire-sealing segment is sized and shaped so as to (i) enable a corresponding wire to be inserted through the corresponding wire passage and (ii) form a seal around the corresponding inserted wire; (b) a substantially rigid front connector body having a front axial passage, wherein (i) a rearward portion of the front connector body includes external threads; (ii) a forward portion of the front connector body is structurally arranged so as to hold one or more electrical contacts that are each connected to a corresponding wire passing through the rear axial passage and the corresponding wire passage of the grommet, and (iii) at least portions, including a rearward portion, of the front axial passage are structurally arranged so as to receive therein the grommet without substantial radial compression of the grommet; (c) a substantially rigid rear connector body having a rear axial passage therethrough, wherein (i) a front end of the rear axial passage is large enough to receive therein a rearward portion of the grommet without substantial radial compression of the grommet, (ii) a rearward-tapered segment of the rear axial passage is structurally arranged so as to receive therein the rearward portion of the grommet, engage the outer surface of the rearward portion of the grommet, and compress radially the rearward portion of the grommet and one or more of the wire-sealing segments of each wire passage, and (iii) a forward portion of the rear connector body, including at least a portion of the tapered segment of the rear axial passage, is structurally arranged to extend into and fit within the rearward portion of the front axial passage, interposed between the rearward portion of the grommet and an inner surface of the rearward portion of the front axial passage; and (d) a nut with a central opening and internal threads, wherein the nut is structurally arranged so as to (i) receive through the central opening a rearward portion of the rear connector body, (ii) obstruct rearward movement of the forward portion of the rear connector body through the central opening, and (iii) engage with the internal threads the external threads of the front connector body, wherein: (e) the forward portion of the rear connector body and the rearward portion of the front connector body are structurally adapted so as to effect non-rotatable engagement of the front and rear connector bodies; and (f) the connector assembly is structurally arranged so that tightening of the nut threadedly engaged on the rearward portion of the front connector body results in forward movement of the nut and the rear connector body toward the front connector body, forward movement of the forward portion of the rear connector body into the rearward portion of the front axial passage, rearward movement of the rearward portion of the grommet into the tapered segment of the rear axial passage, and radial compression, by the tapered segment of the rear axial passage, of the rearward portion of the grommet and one or more of the wire-sealing segments of each wire passage therein.

Example 2

The connector assembly of Example 1 wherein the front connector body is arranged in compliance with a MIL-DTL-38999 specification or an SAE AS50151 standard.

Example 3

The connector assembly of any one of Examples 1 or 2 wherein the grommet extends rearward beyond a rear end of the front connector body.

Example 4

The connector assembly of any one of Examples 1 or 2 wherein a rear end of the front connector body extends rearward beyond a rear end of the grommet.

Example 5

The connector assembly of any one of Examples 1 through 4 wherein: (i) the outer surface of the forward portion of the rear connector body includes a set of one or more longitudinal splines or grooves, (ii) the inner surface of the rearward portion of the front axial passage includes a set of one or more longitudinal splines or grooves, and (iii) engagement of the splines or grooves of the front and rear connector bodies effects the non-rotatable and longitudinally movable engagement thereof.

Example 6

The connector assembly of any one of Examples 1 through 4 wherein (i) the forward portion of the rear connector body includes a set of multiple forward-extending teeth, (ii) the rearward portion of the front connector body includes a set of multiple rearward-extending teeth, and (iii) engagement of the teeth of the front and rear connector bodies effects the non-rotatable engagement thereof.

Example 7

The connector assembly of any one of Examples 1 through 6 wherein each wire passage includes an intervening, transversely enlarged, internal chamber between each adjacent pair of wire-sealing segments along each wire passage.

Example 8

The connector assembly of any one of Examples 1 through 7 wherein (i) the tapered segment of the rear axial passage is structurally arranged so as to compress radially the rearward portion of the grommet and two or more of the wire-sealing segments of each wire passage and (ii) the connector assembly is structurally arranged so that tightening of the nut results in radial compression of two or more of the wire-sealing segments of each wire passage.

Example 9

The connector assembly of any one of Examples 1 through 8 wherein the grommet or the front axial passage includes a rotational indexing structure arranged to permit insertion of the grommet into the front axial passage in only one relative orientation about a longitudinal axis.

Example 10

The connector assembly of any one of Examples 1 through 9 wherein a forward portion of the tapered segment of the rear axial passage is structurally arranged so as to accommodate radial expansion of a portion of the grommet forward of the radially compressed rearward portion of the grommet.

Example 11

The connector assembly of any one of Examples 1 through 10 wherein the front and rear connector bodies are structurally arranged so that, at a forward limit of the forward movement, a gap remains at a front end of the rear connector body that can accommodate radial expansion of a portion of the grommet forward of the radially compressed rearward portion of the grommet.

Example 12

The connector assembly of Example 11 wherein a resilient sealant at least partly fills the gap.

Example 13

The connector assembly of any one of Examples 1 through 12 wherein (i) the rear connector body includes a radially outward-extending circumferential flange and (ii) contact between the flange and a rear end of the front connector body limits the forward movement.

Example 14

The connector assembly of any one of Examples 1 through 13 further comprising a resilient O-ring, wherein, at a forward limit of the forward movement, engagement of the O-ring between the outer surface of the forward portion of the rear connector body and the inner surface of the rear portion of the front axial passage serves to substantially isolate from a use environment the rear portion of the front axial passage.

Example 15

A method employing the connector assembly of any one of Examples 1 through 14, the method comprising: (a) inserting each one of a set of one or more wires through the wire grommet through a corresponding one of the one or more wire passages; (b) securing one or more corresponding electrical contacts, connected to the forward ends of the one or more wires, to be held by the forward portion of the front connector body; (c) inserting the grommet into the front axial passage; (d) engaging the front and rear connector bodies; (e) threadedly engaging the nut and the front connector body; and (f) tightening of the nut threadedly engaged on the rearward portion of the front connector body, thereby resulting in forward movement of the nut and the rear connector body toward the front connector body, forward movement of the forward portion of the rear connector body into the rearward portion of the front axial passage, rearward movement of the rearward portion of the grommet into the tapered segment of the rear axial passage, and radial compression, by the tapered segment of the rear axial passage, of the rearward portion of the grommet and one or more of the wire-sealing segments of each wire passage therein.

Example 16

The method of Example 15 wherein the one or more corresponding electrical contacts are connected to the one or more wires before the one or more wires are inserted through the wire grommet.

Example 17

The method of any one of Examples 15 or 16 wherein the one or more wires are inserted through the wire grommet before inserting the wire grommet into the front axial passage.

Example 18

The method of any one of Examples 15 or 16 wherein the one or more wires are inserted through the wire grommet after inserting the wire grommet into the front axial passage, using an insertion/removal tool that comprises a tube arranged (i) to receive therein one of the one or more wires, (ii) to be inserted along with the wire through the corresponding one of the one or more wire passages, and (iii) to be withdrawn from the corresponding wire passage leaving the wire within the corresponding wire passage.

Example 19

The method of any one of Examples 15 through 18 wherein each one of the one or more wires has a non-circular transverse cross section.

Example 20

The method of any one of Examples 15 through 19 wherein each one of the one or more wires has an oval or elliptical cross section.

Example 21

The method of any one of Examples 15 through 20 wherein each one of the one or more wires includes spiral-wrapped insulation.

Example 22

The method of any one of Examples 15 through 21 further comprising inserting into a sheath surrounding the set of one or more wires the rearward portion of the rear connector body.

Example 23

The method of Example 22 wherein the sheath includes electrically conductive sheathing arranged to serve as electromagnetic shielding for the set of one or more wires, the rear connector body comprises an electrically conductive material, and the electrically conductive sheathing is in electrical contact with the rear connector body.

Example 24

The method of Examples 22 or 23 wherein the sheath includes electrically insulating sheathing.

Example 25

An article comprising a substantially rigid backshell for an electrical connector assembly wherein: (a) the backshell has an axial passage therethrough; (b) a front end of the backshell axial passage is large enough to receive therein a rearward portion of a wire grommet without substantial radial compression of the grommet; (c) a rearward-tapered segment of the backshell axial passage is structurally arranged so as to receive therein the rearward portion of the grommet, engage the outer surface of the rearward portion of the grommet, and compress radially the rearward portion of the grommet and one or more wire-sealing segments of each one of one or more wire passages of the grommet; and (d) a forward portion of the backshell, including at least a portion of the tapered segment of the rear axial passage, is structurally arranged to extend into and fit within a rearward portion of an axial passage of a front connector body, with the grommet positioned within the front axial passage and with the forward portion of the backshell interposed between the rearward portion of the grommet and an inner surface of the rearward portion of the front axial passage.

Example 26

The article of Example 25 wherein the forward portion of the backshell, including at least a portion of the tapered segment of the rear axial passage, is structurally arranged to extend into and fit within a rearward portion of an axial passage of a front connector body that is arranged in compliance with a MIL-DTL-38999 specification or an SAE AS50151 standard, with the grommet positioned within the front axial passage and with the forward portion of the backshell interposed between the rearward portion of the grommet and an inner surface of the rearward portion of the front axial passage.

Example 27

The article of any one of Examples 25 or 26 wherein the tapered segment of the backshell axial passage is structurally arranged so as to compress radially the rearward portion of the grommet and two or more of the wire-sealing segments of each wire passage.

Example 28

The article of any one of Examples 25 through 27 wherein the forward portion of the backshell includes a set of multiple forward-extending teeth arranged to engage a set of multiple rearward-extending teeth of the front connector body and thereby effect substantially non-rotatable engagement of the backshell and the front connector body.

Example 29

The article of any one of Examples 25 through 27 wherein the outer surface of the forward portion of the backshell includes a set of one or more longitudinal splines or grooves arranged to engage a set of one or more longitudinal splines or grooves of the front connector body and thereby effect substantially non-rotatable engagement of the backshell and the front connector body.

Example 30

The article of any one of Examples 25 through 29 wherein a forward portion of the tapered segment of the backshell axial passage is structurally arranged so as to accommodate radial expansion of a portion of the grommet forward of the radially compressed rearward portion of the grommet.

Example 31

The article of any one of Examples 25 through 30 wherein the backshell is structurally arranged so that, at a forward limit of forward movement of the forward portion of the backshell into the front axial passage of the front connector body, a gap remains at a front end of the backshell that can accommodate radial expansion of a portion of the grommet forward of the radially compressed rearward portion of the grommet.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the preceding numbered examples and the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure (including the numbered examples) or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including,"

"having," and variants thereof, wherever they appear, shall be construed as open ended terminology, with the same meaning as if the phrase "at least" were appended after each instance thereof, unless explicitly stated otherwise.

In the appended claims, if the provisions of 35 USC §112 (f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A connector assembly comprising:

(a) a resiliently deformable wire grommet having a substantially cylindrical outer surface and one or more axial wire passages therethrough, wherein each wire passage includes two or more wire-sealing segments and each wire-sealing segment is sized and shaped so as to (i) enable a corresponding wire to be inserted through the corresponding wire passage and (ii) form a seal around the corresponding inserted wire;

(b) a substantially rigid front connector body having a front axial passage, wherein (i) a rearward portion of the front connector body includes external threads and a set of multiple rearward-extending teeth; (ii) a forward portion of the front connector body is structurally arranged so as to hold one or more electrical contacts that are each connected to a corresponding wire passing through the corresponding wire passage of the grommet, and (iii) one or more portions, including a rearward portion, of the front axial passage are structurally arranged so as to receive therein the grommet without substantial radial compression of the grommet;

(c) a substantially rigid rear connector body having a rear axial passage therethrough, wherein (i) a front end of the rear axial passage is large enough to receive therein a rearward portion of the grommet without substantial radial compression of the grommet, (ii) a rearward-tapered segment of the rear axial passage is structurally arranged so as to receive therein the rearward portion of the grommet, engage the outer surface of the rearward portion of the grommet, and compress radially the rearward portion of the grommet and one or more of the two or more wire-sealing segments of each wire passage, (iii) the rear connector body includes a set of multiple forward-extending teeth, and (iv) a forward portion of the rear connector body that extends forward beyond the set of multiple forward-extending teeth, including at least a portion of the tapered segment of the rear axial passage, is structurally arranged to extend into and fit within the rearward portion of the front axial passage, interposed between the rearward portion of the grommet and an inner surface of the rearward portion of the front axial passage; and (d) a nut with a central opening and internal threads, wherein the nut is structurally arranged so as to (i) receive through the central opening a rearward portion of the rear connector body, (ii) obstruct rearward movement of the forward portion of the rear connector body through the central opening, and (iii) engage with the internal threads the external threads of the front connector body, wherein:

(e) the set of multiple forward-extending teeth of the rear connector body and the set of multiple rearward-extending teeth of the front connector body are structurally arranged so as to effect non-rotatable engagement of the front and rear connector bodies; and (f) the connector assembly is structurally arranged so that tightening of the nut threadedly engaged on the rearward portion of the front connector body results in (i) forward movement of the nut and the rear connector body toward the front connector body, (ii) forward movement of the forward portion of the rear connector body into the rearward portion of the front axial passage, (iii) rearward movement of the rearward portion of the grommet into the tapered segment of the rear axial passage, (iv) radial compression, by the tapered segment of the rear axial passage, of the rearward portion of the grommet and one or more of the two or more wire-sealing segments of each wire passage therein, and (v) engagement of the set of multiple forward-extending teeth with the set of multiple rearward-extending teeth so as to effect non-rotatable engagement of the front and rear connector bodies.

2. The connector assembly of claim 1 wherein the front connector body is arranged in compliance with a MIL-DTL-38999 specification or an SAE AS50151 standard.

3. The connector assembly of claim 1 wherein each wire passage includes an intervening, transversely enlarged, internal chamber between each pair of adjacent wire-sealing segments along each wire passage.

4. The connector assembly of claim 1 wherein (i) the tapered segment of the rear axial passage is structurally arranged so as to compress radially the rearward portion of the grommet and two or more of the two or more wire-sealing segments of each wire passage and (ii) the connector assembly is structurally arranged so that tightening of the nut results in radial compression of two or more of the two or more wire-sealing segments of each wire passage.

5. The connector assembly of claim 1 wherein the grommet extends rearward beyond a rear end of the front connector body.

6. The connector assembly of claim 1 wherein a rear end of the front connector body extends rearward beyond a rear end of the grommet.

7. The connector assembly of claim 1 wherein a forward portion of the tapered segment of the rear axial passage is structurally arranged so as to accommodate radial expansion of a portion of the grommet forward of the radially compressed rearward portion of the grommet.

8. The connector assembly of claim 1 wherein the rear connector body is structurally arranged so that, at a forward limit of the forward movement, a gap remains at a front end of the rear connector body that can accommodate radial expansion of a portion of the grommet forward of the radially compressed rearward portion of the grommet.

9. A method employing the connector assembly of claim 1, the method comprising:

(A) inserting each one of a set of one or more wires through the wire grommet through a corresponding one of the one or more wire passages;

(B) securing one or more corresponding electrical contacts, connected to the forward ends of the one or more wires, to be held by the forward portion of the front connector body;

(C) inserting the grommet into the front axial passage;

(D) engaging the front and rear connector bodies;

(E) threadedly engaging the nut and the front connector body; and (F) tightening the nut threadedly engaged on the rearward portion of the front connector body, thereby resulting in (i) forward movement of the nut and the rear connector body toward the front connector body, (ii) forward movement of the forward portion of the rear connector body into the rearward portion of the front axial passage, (iii) rearward movement of the rearward portion of the grommet into the tapered segment of the rear axial passage, (iv) radial compression, by the tapered segment of the rear axial passage, of the rearward portion of the grommet and one or more of the two or more wire-sealing segments of each wire passage therein, and (v) engagement of the set of multiple forward-extending teeth with the set of multiple rearward-extending teeth so as to effect non-rotatable engagement of the front and rear connector bodies.

10. The method of claim 9 wherein the one or more wires are inserted through the wire grommet before inserting the wire grommet into the front axial passage.

11. The method of claim 9 wherein the one or more wires are inserted through the wire grommet after inserting the wire grommet into the front axial passage, using an insertion/removal tool that comprises a tube arranged (i) to receive therein one of the one or more wires, (ii) to be inserted along with the wire through the corresponding one of the one or more wire passages, and (iii) to be withdrawn from the corresponding wire passage leaving the wire within the corresponding wire passage.

12. The method of claim 9 wherein each one of the one or more wires has a non-circular transverse cross section.

13. The method of claim 9 wherein each one of the one or more wires has an oval or elliptical cross section.

14. The method of claim 9 wherein each one of the one or more wires includes spiral-wrapped insulation.

15. An article comprising a substantially rigid backshell for an electrical connector assembly wherein:

(a) the backshell has an axial passage therethrough and a set of multiple forward-extending teeth;

(b) a front end of the backshell axial passage is large enough to receive therein a rearward portion of a wire grommet without substantial radial compression of the grommet;

(c) a rearward-tapered segment of the backshell axial passage is structurally arranged so as to receive therein the rearward portion of the grommet, engage an outer surface of the rearward portion of the grommet, and compress radially the rearward portion of the grommet and one or more wire-sealing segments of each one of one or more wire passages of the grommet;

(d) a forward portion of the backshell that extends forward beyond the set of multiple forward-extending teeth, including at least a portion of the tapered segment of the rear axial passage, is structurally arranged to extend into and fit within a rearward portion of an axial passage of a front connector body, with the grommet positioned within the front axial passage and with the forward portion of the backshell interposed between the rearward portion of the grommet and an inner surface of the rearward portion of the front axial passage; and (e) the set of multiple forward-extending teeth is arranged to engage a set of multiple rearward-extending teeth of the front connector body and thereby effect substantially non-rotatable engagement of the backshell and the front connector body.

16. The article of claim 15 wherein the forward portion of the backshell, including at least a portion of the tapered segment of the rear axial passage, is structurally arranged to extend into and fit within a rearward portion of an axial passage of a front connector body that is arranged in compliance with a MIL-DTL-38999 specification or an SAE AS 50151 standard, with the grommet positioned within the front axial passage and with the forward portion of the backshell interposed between the rearward portion of the grommet and an inner surface of the rearward portion of the front axial passage.

17. The article of claim 15 wherein the tapered segment of the backshell axial passage is structurally arranged so as to compress radially the rearward portion of the grommet and two or more of the one or more wire-sealing segments of each wire passage.

18. The article of claim 15 wherein a forward portion of the tapered segment of the backshell axial passage is structurally arranged so as to accommodate radial expansion of a portion of the grommet forward of the radially compressed rearward portion of the grommet.

19. The article of claim 15 wherein the backshell is structurally arranged so that, at a forward limit of forward movement of the forward portion of the backshell into the front axial passage of the front connector body, a gap remains at a front end of the backshell that can accommodate radial expansion of a portion of the grommet forward of the radially compressed rearward portion of the grommet.

* * * * *